US008260168B2

(12) United States Patent
Eom

(10) Patent No.: US 8,260,168 B2
(45) Date of Patent: Sep. 4, 2012

(54) IMAGE FORMING APPARATUS WITH ENHANCED ELECTRICAL CONNECTION MAINTENANCE, AND CONTROL METHOD THEREOF

(75) Inventor: Yoon Seop Eom, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 552 days.

(21) Appl. No.: 12/414,703

(22) Filed: Mar. 31, 2009

(65) Prior Publication Data

US 2009/0245861 A1 Oct. 1, 2009

(30) Foreign Application Priority Data

Apr. 1, 2008 (KR) ..... 1-2008-0030284
Mar. 13, 2009 (KR) ..... 1-2009-0021493

(51) Int. Cl.
*G03G 15/00* (2006.01)

(52) U.S. Cl. ..... 399/90

(58) Field of Classification Search ..... 399/90, 399/110, 111, 116, 119
See application file for complete search history.

(56) References Cited

U.S. PATENT DOCUMENTS 7,702,253 B2 * 4/2010 Nishimura ..... 399/116
2006/0216046 A1 * 9/2006 Hatakeyama ..... 399/27
2008/0240774 A1 * 10/2008 Fukamachi et al. ..... 399/111

FOREIGN PATENT DOCUMENTS

JP 07-320825 12/1995

OTHER PUBLICATIONS

English Abstract of JP-07-320825.
English Language of JP-07-320825.

* cited by examiner

*Primary Examiner* — Quana M Grainger
(74) *Attorney, Agent, or Firm* — Stanzione & Kim, LLP

(57) ABSTRACT

An image forming apparatus is disclosed. The image forming apparatus includes a body having an opening perforated in one side thereof, a developing unit detachably mounted to the body through the opening, a body cover configured to cover a rear portion of the developing unit in a mounting direction of the developing unit and adapted to open or close the opening, and a memory unit provided at the rear portion of the developing unit and having a developing device terminal. The body cover includes a body terminal to come into contact with the memory unit. Accordingly, an electrical connection between the developing unit and the body can be made less susceptible to vibration, etc. caused during operation of a drive motor.

21 Claims, 21 Drawing Sheets

FIG. 22

| | normal conditions | | | | abnormal conditions | | | |
|---|---|---|---|---|---|---|---|---|
| | Y | M | C | K | Y | M | C | K |
| below than 10[Ω] (the number of times) | 49 | 44 | 49 | 50 | 0 | 3 | 10 | 43 |
| 10[Ω]~100[Ω] (the number of times) | 1 | 0 | 1 | 0 | 0 | 2 | 8 | 1 |
| more than 100[Ω] (the number of times) | 0 | 6 | 0 | 0 | 50 | 45 | 32 | 6 |
| Max [Ω] | 10.47 | 6575 | 11.68 | 2.58 | 14411 | 16395 | 16441 | 14310 |
| Min [Ω] | 1.49 | 1.39 | 1.59 | 1.26 | 6626 | 7.28 | 1.47 | 1.40 |
| Avg [Ω] | 4.28 | 792 | 3.24 | 1.58 | 9248 | 8439 | 6207 | 1211 |

FIG. 23

| | normal conditions | | | | abnormal conditions | | | |
|---|---|---|---|---|---|---|---|---|
| | Y | M | C | K | Y | M | C | K |
| below than 10[Ω] (the number of times) | 50 | 50 | 50 | 50 | 50 | 50 | 50 | 50 |
| 10[Ω]~100[Ω] (the number of times) | 0 | 0 | 0 | 0 | 0 | 0 | 0 | 0 |
| more than 100[Ω] (the number of times) | 0 | 0 | 0 | 0 | 0 | 0 | 0 | 0 |
| Max [Ω] | 1.02 | 1.19 | 1.21 | 0.97 | 1.12 | 1.36 | 1.99 | 1.08 |
| Min [Ω] | 0.84 | 0.76 | 0.75 | 0.79 | 0.77 | 0.71 | 0.71 | 0.76 |
| Avg [Ω] | 0.90 | 0.86 | 0.88 | 0.88 | 0.93 | 0.85 | 0.90 | 0.88 |

IMAGE FORMING APPARATUS WITH ENHANCED ELECTRICAL CONNECTION MAINTENANCE, AND CONTROL METHOD THEREOF

CROSS-REFERENCE TO RELATED APPLICATION

This application claims the benefit of Korean Patent Application No. 2008-0030284, filed on Apr. 1, 2008 and Korean Patent Application No. 2009-0021493, filed on Mar. 13, 2009 in the Korean Intellectual Property Office, the disclosure of which are incorporated herein by reference.

BACKGROUND

1. Field of the Invention

The present invention relates to an image forming apparatus, and a method of controlling the same, and, more particularly, to an image forming apparatus and a control method thereof, in which electrical connection between a developing unit and the main body of the apparatus can be made less susceptible vibration, contamination, etc.

2. Description of the Related Art

Image forming apparatuses are devised to form an image on a printing medium. Examples of image forming apparatuses may include, e.g., printers, copiers, facsimiles, and so-called multi-functional devices that combine some of the functionalities of the aforementioned.

Of the variety of image forming apparatuses, in an electrophotographic image forming apparatus as a kind of image forming apparatuses, light is irradiated to a photosensitive member charged with a predetermined electric potential so as to form an electrostatic latent image on a surface of the photosensitive member, and developer is fed to the electrostatic latent image, forming a visible image. The visible image, formed on the photosensitive member, is transferred to a printing medium directly or indirectly by way of an intermediate transfer member. The image transferred to the printing medium is fixed to the printing medium via a fusing process.

In the above-described printing operation, a developing device included in the image forming apparatus feeds developer to the photosensitive member, to form a visible image on the surface of the photosensitive member. Generally, the developing device takes the form of a cartridge in which a developer reservoir, a charger, a developing member, a cleaning member, etc. are integrated to a single unit. The developing device may be detachably mounted in a body of the image forming apparatus.

The developing device has a limited lifespan and must be replaced or replenished. To replace or replenish the developing device at an appropriate time for effective management of the image forming apparatus, it may be necessary for the user to know a variety of information about the developing device.

The developing device may be provided with a memory unit, which stores a variety of information required for management of the developing device. The memory unit may store information including a residual amount of developer and the remaining lifespan of constituent elements.

The memory unit is provided at one side thereof with developing device terminals, and body terminals corresponding to the developing device terminals are provided at the body of the image forming apparatus. Once the developing device is mounted to the image forming apparatus, the developing device terminals and body terminals come into contact with one another, achieving electrical connection therebetween. In a state wherein the developing device is electrically connected to the body, the image forming apparatus is able to recognize the information stored in the memory unit and display it to a user, or performs data transmission/reception to update the information stored in the memory unit by performing desired calculations using the recognized information and transmitting information relating to the results of the calculations to the memory unit.

To initiate a printing operation, the image forming apparatus typically undergoes a warm-up process to test the operational status of respective constituent elements including a drive motor. The warm-up process includes data transmission/reception via the memory unit. However, due to vibration caused during operation of the drive motor, etc., there is a risk of poor contact between the developing device terminals and the body terminals. To avoid malfunctions, thus the data transmission/reception to and from the memory unit is performed after the test operation of the drive motor, etc. is finished and the vibration has adequately subsided.

Conventionally, since time required for data transmission/reception on a per developing device basis can be up to about 2 seconds, an image forming apparatus including four developing devices may take up about 8 seconds for data transmission/reception alone. The time required for data transmission/reception causes an increase of First Page Output Time (FPOT) as a criterion to evaluate performance of the image forming apparatus.

To improve general printing performance of the image forming apparatus, and to reduce the FPOT, it is necessary to assure effective data transmission/reception between the developing device and the body of the image forming apparatus.

However, in conventional image forming apparatuses, the developing device terminal is merely embodied as a rigid gold-plated plane while, the body terminal that makes contact with the developing device terminal has a rigid convexly arched distal end. With this configuration, the developing device terminal and body terminal are electrically connected to each other through a single point of contact.

A drive device, e.g., a motor, is provided in the image forming apparatus, e.g., to move a printing medium for image formation or the like. Vibration occurs during operation of the drive device, and may temporarily interrupt the point contact between the developing device terminal and the body terminal, causing temporary open-circuiting of the electrical connection. Consequently, data transmission between the memory unit and the body is interrupted, resulting in malfunction of the image forming apparatus.

Further, during the use of the image forming apparatus, a developer leak may cause developer to be accumulated at the point contact region between the developing device terminal and the body terminal, resulting in a poor electrical connection.

To avoid the above-described problems, conventional image forming apparatuses stop the data transmission between the memory unit and the body during operation of the drive device. However, unfortunately, this adds the transmission stoppage time to the total printing time and consequently, increases the printing time and the FPOT, causing consumer dissatisfaction.

SUMMARY OF DISCLOSURE

According to an aspect of the present disclosure, an image forming apparatus may comprise a main body having an opening perforated in one side thereof, a developing unit detachably mounted to the main body through the opening, a body cover configured to cover a rear portion of the developing unit with respect to a mounting direction of the developing unit, the body cover being adapted to open or close the opening, and a memory unit provided at the rear portion of the developing unit and having a developing device terminal, the body cover includes a body terminal that comes into contact with the memory unit.

The body terminal may include one or more body terminals, and at least one of the body terminals may include a plurality of contact bosses provided on one end thereof.

The contact bosses may include three contact bosses arranged by an approximately constant distance about the center of the body terminal.

The image forming apparatus may further comprise a body terminal housing provided at the body cover and receiving the body terminal, an elastic member provided to elastically bias the body terminal toward the developing device terminal, and a guide hole to guide the body terminal.

The body terminal may include a terminal body portion, an elastic member coupling portion to which the elastic member is coupled, and a holding portion provided between the terminal body portion and the elastic member coupling portion.

The terminal body portion of the body terminal and the guide hole may be spaced apart from each other.

The body terminal may be provided so as to be tilted by a constant angle with respect to a center axis of the guide hole.

The developing unit may includes a plurality of developing devices, and at least one of the plurality of developing devices may be mounted to the main body so as to be tilted by a predetermined angle with respect to a mounting surface of the image forming apparatus.

The image forming apparatus may further comprise a drive force receiver provided at one side of the developing unit and adapted to receive drive force from the main body, the memory unit may be arranged closer to an opposite side of the drive force receiver on the basis of the center of a width direction of the developing unit.

The image forming apparatus may further comprise a power receiver provided at the other side of the developing unit opposite to one side of the developing unit provided with the drive force receiver with respect to the width direction and adapted to receive electric power from the main body.

A waste developer collector to collect waste developer may be provided adjacent to the power receiver in a rear region of the main body with respect to the mounting direction of the developing unit.

The developing device terminal and body terminal respectively may include a plurality of developing device terminals and a plurality of body terminals, one of the developing device terminals may be a data communication terminal, and of the developing device terminals, the data communication terminal may be arranged the farthest from the drive force receiver with respect to the width direction of the developing unit.

The developing device terminal and body terminal respectively may include a plurality of developing device terminals and a plurality of body terminals, one of the developing device terminals may be a ground terminal, and of the developing device terminals, the ground terminal may be arranged the closest from the drive force receiver with respect to the width direction of the developing unit.

The developing device terminals the ground terminal may have the largest area.

The image forming apparatus may further comprising a press member provided at the body cover, the press member may presses a rear surface of the developing unit when the developing unit is mounted in the main body.

The image forming apparatus may further comprise a press member guide provided at the body cover and adapted to guide forward and rearward movement of the press member; and an elastic member provided to elastically bias the press member in a given direction.

The developing device terminal may include an elastic plate deformable by an external force, and a conductive plate provided on a contact surface thereof that comes into contact with the body terminal.

the developing device terminal may include a latticed conductive plate adapted to come into contact with the body terminal.

The developing device terminal may include a latticed elastic conductive tube adapted to come into contact with the body terminal, and the elastic conductive tube may include an elastic core deformable by an external force, and at least one layer of conductive coating over the core.

The developing device terminal may include one or more elastic conductive bosses spaced apart from one another and adapted to come into contact with the body terminal.

A memory unit of an image forming apparatus may be provided at a developing device detachably mounted to a main body of the image forming apparatus, the memory unit may have an electrical connection with a body terminal provided at the main body, the body terminal may be attached to a body terminal housing provided at a body cover that is able to be opened from or closed to the main body, the body terminal housing may comprise an elastic member provided to elastically bias the body terminal toward the memory unit, and a guide hole to guide the body terminal that may move forward and rearward by the elastic member, and the body terminal may comprise a terminal body portion adapted to move forward and rearward while coming into contact with an inner circumferential surface of the guide hole, and three contact bosses equidistantly arranged about a center axis of the body terminal for the electrical connection.

A method of controlling an image forming apparatus forming apparatus having a main body to which a developing device is mounted, the main body housing a motor for driving at least one moveable component of the image forming apparatus may comprise accessing a memory of the developing device while the motor is in operation; and stopping the motor from operating when the accessing of the memory fails.

The method may further comprise, when the accessing of the memory fails, prior to the stopping of the motor, repeatedly attempting the memory access each re-attempt of the memory access being made after a predetermine pause time.

The predetermined pause time may be 100 ms, and wherein the re-attempt of the memory access is made 3 times.

A developing device mountable in a main body of an image forming apparatus, may comprise a memory unit; and a developing device terminal coupled to the memory unit, the developing device terminal being configured to contact a body terminal disposed on the main body of the image forming apparatus to provide an electrical connection path between the memory unit and the image forming apparatus, the body terminal is disposed in a body terminal housing formed on a body cover that covers an opening of the main body through which the developing device enters the main body to be mounted therein.

BRIEF DESCRIPTION OF THE DRAWINGS

Various features and advantages of the embodiments of the present invention will become apparent and more readily appreciated from the following description of the embodiments, taken in conjunction with the accompanying drawings, of which:

FIGS. 22 and 23 are tables illustrating experimental results of contact performance between a body terminal and a developing device terminal of the image forming apparatus according to the embodiments.

DETAILED DESCRIPTION

Figure 1:
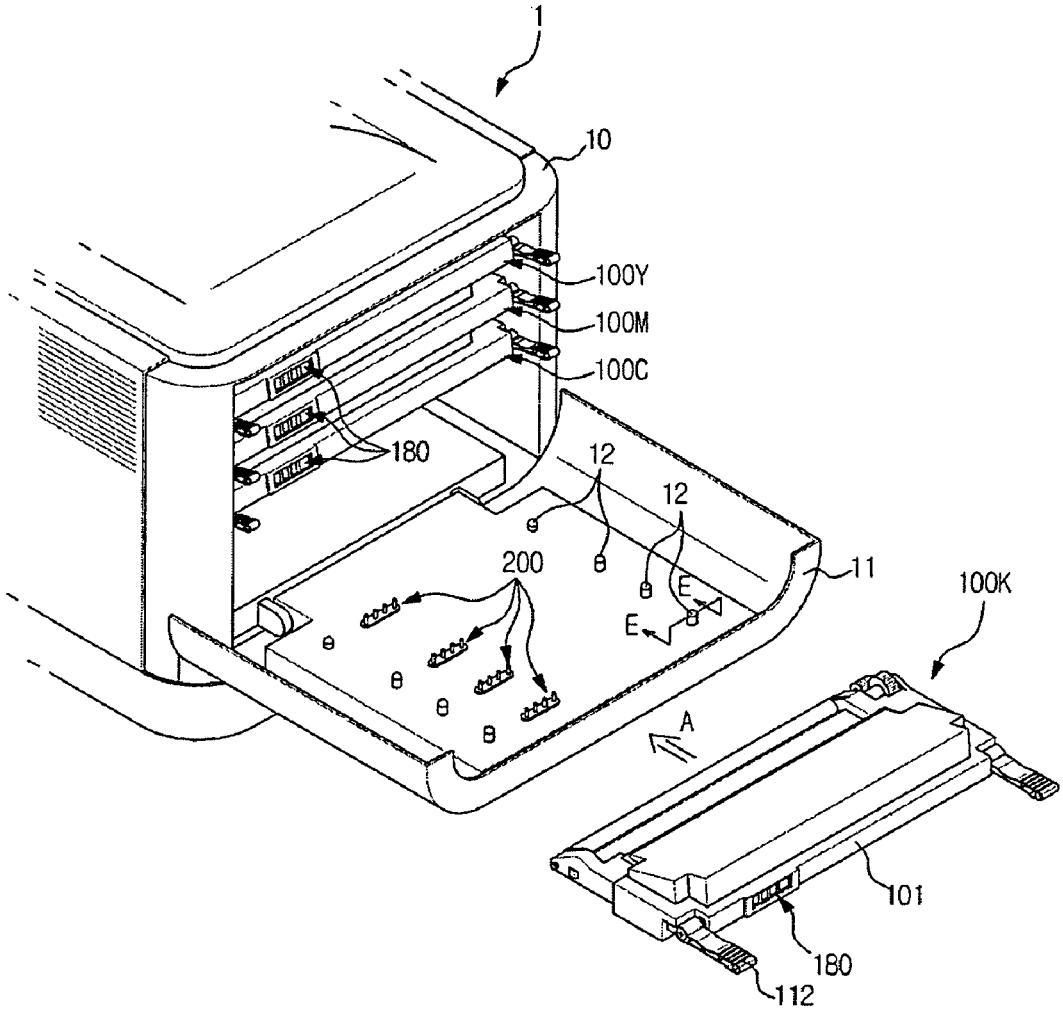
FIG. 1 is a perspective view illustrating an image forming apparatus according to an embodiment.

Reference will now be made in detail to the embodiments, examples of which are illustrated in the accompanying drawings, wherein like reference numerals refer to like elements throughout. Some of the detailed construction and elements are provided to assist in a comprehensive understanding of the embodiments, and may not be required to practice the various aspects of the present invention. Thus, it should be readily apparent that aspects of the present invention may be carried out without those details.

Figure 2:
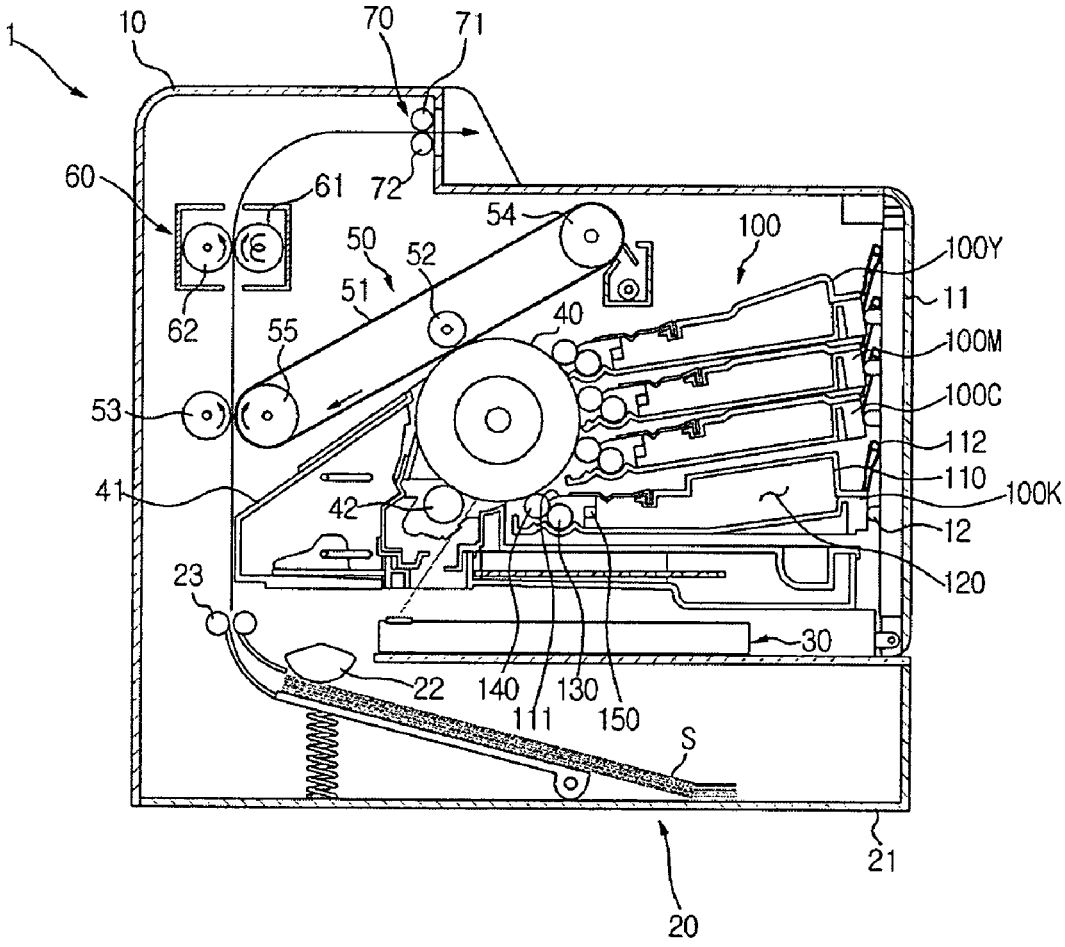
FIG. 2 is a sectional view of the image forming apparatus shown in FIG. 1.

FIG. 1 is a perspective view illustrating an image forming apparatus according to an embodiment, and FIG. 2 is a sectional view of the image forming apparatus shown in FIG. 1.

As shown in the drawings, the image forming apparatus 1 according to an embodiment may include a body 10, a printing medium supply device 20, a light scanning device 30, a photosensitive member 40, a developing unit 100, a transfer device 50, a fusing device 60, and a printing medium discharge device 70.

The developing unit 100 may include four developing devices 100K, 100C, 100M, and 100Y, each of which receives developer of different colors, for example, Black (K), Cyan (C), Magenta (M), and Yellow (Y), respectively. It should be noted, as should be apparent, that the present invention is not limited to any particular number of developing devices. Indeed, as it well known, an image forming apparatus may be of a monochromatic or black-and-white type, which would only require one developing device storing only the black (K) developer.

The body 10 defines an external appearance of the image forming apparatus 1, and supports a variety of elements installed therein. A body cover 11 is pivotally coupled to one side of the body 10, to open or close a part of the body 10. A user accesses the interior of the body 10 through the body cover 11, to attach or detach a variety of elements including the developing devices 100K, 100C, 100M and 100Y.

Figure 18:
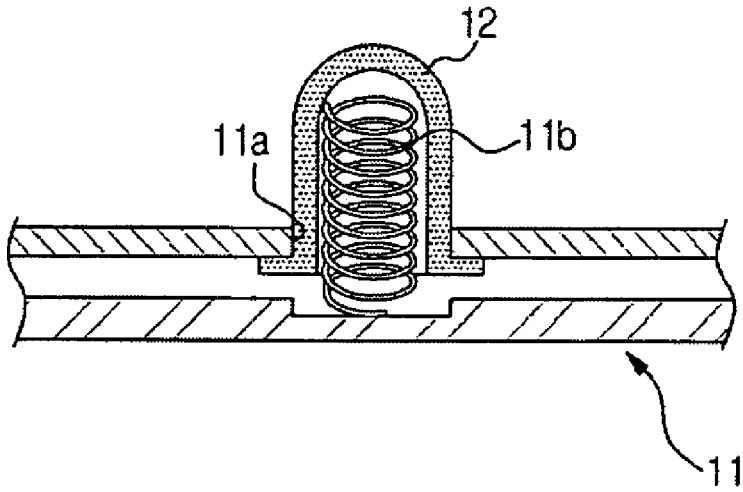
FIG. 18 is a sectional view taken along the line E-E of FIG. 1, illustrating a press member according to another embodiment.
Figure 19:
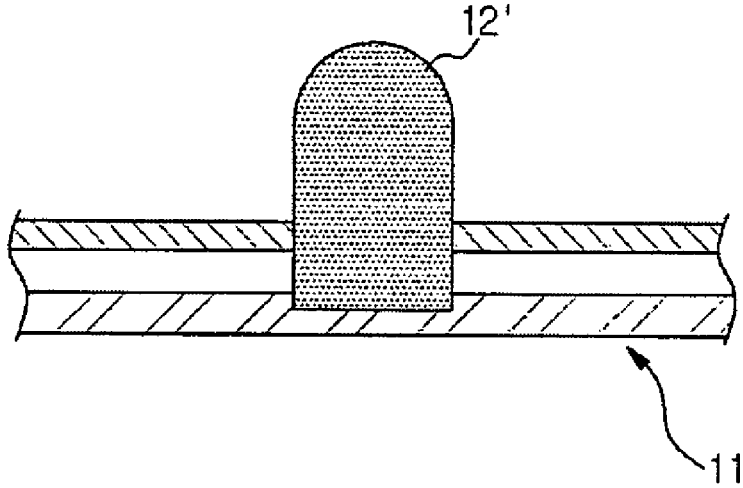
FIG. 19 is a view corresponding to FIG. 18, illustrating a press member according to a further embodiment.

The body cover 11 is located at the rear side of the developing devices 100K, 100C, 100M, and 100Y with respect to a mounting direction (designated by the arrow A) of the developing devices 100K, 100C, 100M and 100Y. Press members 12 are provided at an inner surface of the body cover 11, to press the developing devices 100K, 100C, 100M and 100Y for preventing movement of the developing devices 100K, 100C, 100M and 100Y. The press members 12 protrude from the inner surface of the body cover 11, thereby pressing both sides of rear surfaces 101 of the respective developing device 100K, 100C, 100M or 100Y in a closed state of the body cover 11. To more stably support the developing devices 100K, 100C, 100M and 100Y using the press members 12, for example, as shown in FIG. 18, the image forming apparatus according to the present embodiment may further include a press member guide 11*a* provided at the body cover 11 and serving to guide forward and rearward movement of the press member 12, and an elastic member 11*b* to elastically bias the press member 12 in a given direction. In this case, the press members 12 may be made of elastomer. With this configuration, the developing devices 100K, 100C, 100M and 100Y of the present embodiment can be more stably supported, and no noise occurs due to collision between the press members 12 and the rear surfaces 101 of the developing devices 100K, 100C, 100M and 100Y when the body cover 11 is closed. Alternatively, as shown in FIG. 19, a press member 12' made of elastomer may be used alone to support the rear surface 101 of the corresponding developing device 100K, 100C, 100M or 100Y using only elasticity thereof.

The printing medium supply device 20 includes a cassette 21 in which printing media S is loaded, a pickup roller 22 to pick up the printing media S loaded in the cassette 21 sheet by sheet, and delivery rollers 23 to deliver the picked-up printing medium S to the transfer device 50.

The light scanning device 30 irradiates light, which corresponds to image information, to the photosensitive member 40, forming an electrostatic latent image on a surface of the photosensitive member 40.

The photosensitive member 40 is rotatably mounted to a photosensitive member housing 41, which is detachably mounted in the body 10. A charging roller 42 is mounted in the photosensitive member housing 41. The charging roller 42 charges the photosensitive member 40 with a predetermined electric potential before the light scanning device 30 irradiates light to the photosensitive member 40.

The transfer device 50 includes an intermediate transfer belt 51, a first transfer roller 52, and a second transfer roller 53.

The intermediate transfer belt 51 is supported by supporting rollers 54 and 55 and is adapted to travel at the same speed as a linear speed of the photosensitive member 40. The first transfer roller 52 is arranged opposite the photosensitive member 40 with the intermediate transfer belt 51 interposed therebetween, to transfer a visible image formed on the photosensitive member 40 to the intermediate transfer belt 51.

The second transfer roller 53 is arranged opposite the supporting roller 55 with the intermediate transfer belt 51 interposed therebetween. The second transfer roller 53 is spaced apart from the intermediate transfer belt 51 while the image is transferred from the photosensitive member 40 to the intermediate transfer belt 51, and comes into contact with the intermediate transfer belt 51 at a predetermined pressure after the image on the photosensitive member 40 is completely transferred to the intermediate transfer belt 51. The image on the intermediate transfer belt 51 is transferred to the printing medium S when the second transfer roller 53 comes into contact with the intermediate transfer belt 51.

The fusing device 60 includes a heating roller 61 having a heater, and a press roller 62 installed opposite the heating roller 61. When the printing medium S passes through a gap between the heating roller 61 and the press roller 62, the image is fixed to the printing medium S by the heat transmitted from the heating roller 61 and the pressure exerted between the heating roller 61 and the press roller 62.

The printing medium discharge device 70 includes a printing medium discharge roller 71, and a printing medium backup roller 72, to discharge the printing medium, which has passed through the fusing device 60, to the outside of the body 10.

The developing unit 100 is adapted to form a visible image by supplying developer to the photosensitive member on which the electrostatic latent image is formed. The four developing devices 100K, 100C, 100M and 100Y provided for respective colors are arranged in parallel close to one another in a rotating direction of the photosensitive member 40.

As shown in FIG. 2, the developing devices 100K, 100C, 100M and 100Y of the present embodiment are mounted to the body 10 by an inclination with respect to a mounting surface of the image forming apparatus, i.e. a bottom surface of the body 10. Accordingly, in the image forming apparatus of the present embodiment, on the basis of FIG. 2, the body 10 has a reduced horizontal length and assures more effective utilization of a vertical space, resulting in more compact size of the image forming apparatus.

Each of the developing devices 100K, 100C, 100M and 100Y includes a device housing 110, a developer reservoir 120, a feeding roller 130, a developing roller 140, and an agitating member 150. For convenience of illustration, only constituents of the developing device 100K are designated by reference numerals 110, 120, 130, 140, and 150 in FIG. 2.

Each developing device housing 110 defines an external appearance of respective corresponding one of developing devices 100K, 100C, 100M or 100Y, and supports a variety of elements installed therein. The developer reservoir 120 stores developer to be fed to the photosensitive member 40. The agitating member 150 is rotatably installed in the developer reservoir 120. The agitating member 150 delivers the developer stored in the developer reservoir 120 toward the feeding roller 130 while agitating the developer to prevent aggregation of the developer.

The feeding roller 130 feeds the developer stored in the developer reservoir 120 to the developing roller 140. When a developing bias is applied to the developing roller 140, the developing roller 140 attaches the developer to the surface of the photosensitive member 40, on which the electrostatic latent image is formed, thereby forming a visible image.

A regulator member 111 is formed at one side of an upper surface of the device housing 110 and is used to regulate the thickness of the layer of developer that is attached to the surface of the developing roller 140.

Grips 112 may be rotatably provided at both sides of a rear end of the device housing 110. The grips 112 allow the user to easily grip the respective developing devices 100K, 100C, 100M and 100Y during the detachment/attachment of the developing devices 100K, 100C, 100M and 100Y.

Figure 3:
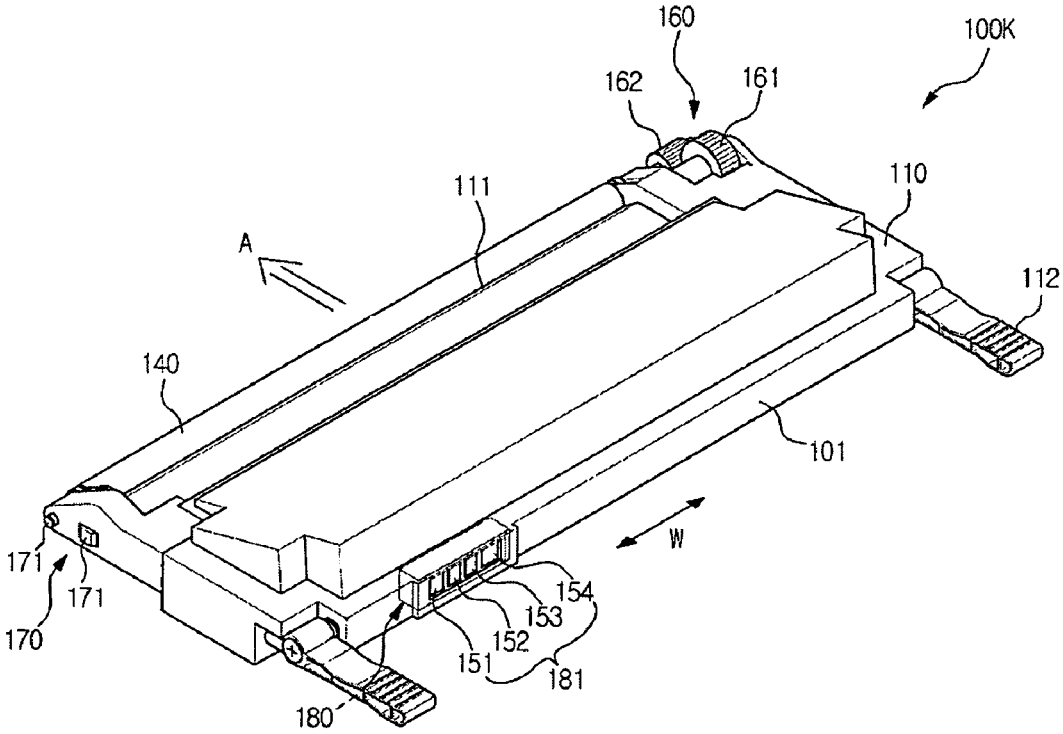
FIG. 3 is a perspective view of a developing device shown in FIG. 1.
Figure 4:
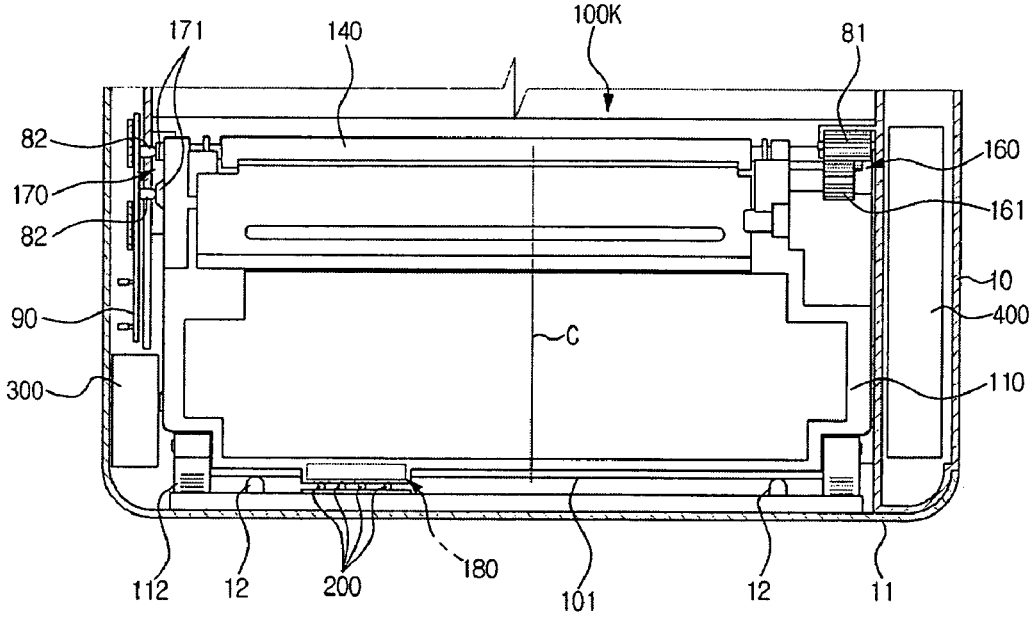
FIG. 4 is a sectional view of the developing device mounted to the image forming apparatus shown in FIG. 1.

FIG. 3 is a perspective view of the developing device shown in FIG. 1, and FIG. 4 is a sectional view of the developing device mounted to the image forming apparatus shown in FIG. 1. Although the developing device 100K, which stores black developer will be described below, the following description is similarly applicable to the remaining developing devices 100C, 100M and 100Y.

As shown in the drawings, the developing device 100K includes a drive force receiver 160 to receive a drive force from the body 10 of the image forming apparatus, and a power receiver 170 to receive electric power from the body 10. The drive force receiver 160 and the power receiver 170 are located on the opposite sides in the width direction (designated by the arrow W) of the developing device 100K.

The drive force receiver 160 serves to receive power required to drive the developing roller 140, feeding roller 130 (FIG. 2) and agitating member 150 (FIG. 2), and is provided at one side of a leading end of the developing device 100K with respect to the direction (designated by the arrow A) of mounting the developing device 100K to the body 10. The drive force receiver 160 includes a connecting gear 161 rotatably mounted to the device housing 110 and a developing roller drive gear 162 engaged with the connecting gear 161.

The body 10 is provided with a power transmission gear 81 to transmit power to the developing device 100K. When the developing device 100K is mounted in the body 10, the connecting gear 161 of the developing device 100K is engaged with the power transmission gear 81. The power transmission gear 81 is rotated by a drive motor (not shown) mounted in the body 10. The connecting gear 161, which is engaged with, and thereby rotated by, the power transmission gear 81, transmits the power to the developing roller drive gear 162, causing rotation of the developing roller 140. The connecting gear 161 also rotates the feeding roller 130 (FIG. 2) and agitating member 150 (FIG. 2). Reference numeral 400 represents a drive unit including the drive motor and a gear train (not shown) to transmit a drive force generated from the drive motor to the power transmission gear 81.

The power receiver 170 serves to receive power required to charge the developing roller 140, feeding roller 130, or regulating member 111, and is provided on the other side of the leading end of the developing device 100K opposite to the drive force receiver 160. The power receiver 170 may include first electric contacts 171 exposed from a side surface of the developing device 100K. A circuit board 90 is arranged in the body 10 at a position adjacent to the power receiver 170. The body 10 may also be provided with second electric contacts 82 at positions corresponding to the first electric contacts 171. The second electric contacts 82 are electrically connected to the circuit board 90. When the developing device 100K is mounted in the body 10, the first electric contacts 171 of the developing device 100K are connected to the second electric contacts 82 of the body 10. Power applied from the circuit board 90 is transmitted to the developing device 100K via the second electric contacts 82 and first electric contacts 171.

As shown in FIG. 4, the image forming apparatus of the present embodiment further includes a waste developer collector 300 provided at the body 10. Based on a mounting position of the developing device 100K as shown in FIG. 4, the waste developer collector 300 is located behind the left side of the developing device 100K and the drive unit 400 is located at the right side of the developing device 100K. For reference, the waste developer collector 300 of the present embodiment is detachably mounted to the body 10 and is used to collect waste developer remaining on the intermediate transfer belt 51.

The operation of the image forming apparatus having the above-described configuration will be briefly described with reference to FIGS. 1 to 4. If a printing operation is initiated, the charging roller 42 uniformly charges the surface of the photosensitive member 40. The light scanning device 30 irradiates light, corresponding to image information of any one color, for example, yellow, to the uniformly changed surface of the photosensitive member 40, allowing an electrostatic latent image corresponding to the yellow image to be formed on the photosensitive member 40.

Subsequently, as a developing bias is applied to the developing roller 140 of the yellow developing device 100Y, yellow developer is attached to the electrostatic latent image to thereby form a yellow visible image on the photosensitive member 40. The visible image is transferred to the intermediate transfer belt 51 by the first transfer roller 52.

After completing the transfer of the yellow image for a single page, the light scanning device 30 irradiates light, corresponding to image information of another color, for example, magenta, to the photosensitive member 40, forming an electrostatic latent image corresponding to the magenta image on the photosensitive member 40. The magenta developing device 100M feeds magenta developer to the electrostatic latent image to form a magenta visible image. The magenta visible image formed on the photosensitive member 40 is transferred to the intermediate transfer belt 51 by the first transfer roller 52. In this case, the magenta visible image overlaps the previously transferred yellow visible image.

By repeating the above-described operation for cyan and black developers, a color image formed by overlapping the yellow, magenta, cyan and black images can be formed on the intermediate transfer belt 51. The resulting color image is transferred to the printing medium passing between the intermediate transfer belt 51 and the second transfer roller 53. Then, the printing medium is discharged to the outside of the body 10 by way of the fusing device 60 and printing medium discharge device 70.

During the above-described printing operation, the developer stored in the developing devices 100K, 100C, 100M and 100Y is gradually consumed, and the remaining useful life of constituent elements such as the developing roller 140 or the feeding roller 130 may also be reduced. Therefore, a user must know a variety of information about the status of the developing devices 100K, 100C, 100M and 100Y, in order to exchange the developing devices 100K, 100C, 100M and 100Y at an appropriate time.

Each of the developing devices 100K, 100C, 100M and 100Y is provided with a memory unit 180 in which a variety of information is stored. The memory unit 180 may store, e.g., information including specific history of the associated developing device 100K, 100C, 100M or 100Y, a residual amount of developer, and the remaining life of constituent elements such as the developing roller 140 or the feeding roller 130.

The memory unit 180 has developing device terminals 181, which are electrically connected to a power source provided at the body 10 of the image forming apparatus, for example, the circuit board 90. The body 10 has body terminals 200 that come into contact with the developing device terminals 181. The body terminals 200 may be located at the body cover 11 at the rear side of the developing devices 100K, 100C, 100M and 100Y, and are electrically connected to the circuit board 90 through a wire harnesses (not shown).

Hereinafter, the memory unit 180 provided, for example, at the black developing device 100K, will be described. However, the following description is similarly applicable to the memory units 180 provided at the other developing devices 100C, 100M and 100Y.

As shown in FIGS. 1 to 4, although not required, nor limiting, the memory unit 180 may preferably be arranged at a trailing end of the developing device 100K in the direction (designated by the arrow A) of mounting the developing device 100K to the body 10 of the image forming apparatus, and the developing device terminals 181 are exposed to the outside from the rear surface 101 of the developing device 100K.

With the above described configuration, the memory unit 180 may be protected from damage due to high temperatures, or from being contaminated with loose developer. This is possible because the memory unit 180 is located at a distance from the fusing device 60, photosensitive member 40 and developing roller 140 as shown in FIGS. 2 and 3. Further, when the memory unit 180 is located at the rear surface of the developing device 100K, it may also be possible to reduce the likelihood of interference with other elements thus reducing the risk of damage to the developing device terminals 181 when the developing device 100K is mounted to or separated from the body 10. Furthermore, owing to enhanced utilization of left and right spaces of the body 10 as described above, the image forming apparatus according to the present embodiment can achieve more compact size. In other words, when the memory unit 180 is mounted to a lateral portion of the developing device 100K, it is difficult to utilize a space toward a specific lateral surface of the body 10 because the body terminals corresponding to the developing device terminals of the developing device must be installed to the specific lateral surface of the body 10. More specifically, the waste developer collector 300 is located in a left space of the body 10 and the drive unit 400 is located in a right space of the body 10, on the basis of FIG. 4.

According to an embodiment, the memory unit 180 may be shifted laterally from the center C in the width direction of the developing device 100K. More specifically, the memory unit 180 may preferably positioned such that the developing device terminals 181 are located closer to the power receiver 170 than the drive force receiver 160 of the developing device 100K.

Locating the memory unit 180 at a distance from the drive force receiver 160 may have the advantage of reducing the effect thereupon of vibration that may have been caused, e.g., during transmission of a drive force from the body 10 to the drive force receiver 160.

When the memory unit 180 is located closer to the power receiver 170, the body terminals 200 are located at the body cover 11 at positions closer toward the circuit board 90. This may have the effect of reducing a length of the harness (not shown) used to connect the body terminals 200 to the circuit board 90, thereby reducing element costs and negative effects of electromagnetic waves generated around the harness (not shown).

The developing device terminals 181 of the memory unit 180, as shown in FIG. 3, include first to fourth terminals 151, 154, 152 and 153 arranged in the width direction (designated by the arrow W) of the developing device 100K.

The first terminal 151 may be a data communication terminal for information interchange with a control unit (not shown) provided in the body 10 of the image forming apparatus 1. The control unit (not shown) of the image forming apparatus 1 can read required information from the memory unit 180, or can store new information in the memory unit 180, via the first terminal 151.

The second terminal 154 may be a ground terminal to ground the memory unit 180. The third terminal 152 may be a power terminal to apply power to the memory unit 180, and the fourth terminal 153 may be a clock terminal to transmit a clock signal to the memory unit 180.

Of the first to fourth terminals 151, 154, 152 and 153, the first terminal 151 may be located the farthest from the drive force receiver 160 of the developing device 100K. For example, in the example shown in FIG. 3, the first terminal 151 is preferably the leftmost one of the four terminals when the drive force receiver 160 is located at the right side of the developing device 100K.

The reason why the first terminal 151 is located the farthest from the drive force receiver 160 is to minimize occurrence of data transmission failure due to vibration transmitted from the drive force receiver 160.

Of the first to fourth terminals 151, 152, 153 and 154, the closest terminal to the drive force receiver 160 is the second terminal 154. Specifically, as shown in FIG. 4, when the drive force receiver 160 is located at the right side of the developing device 100K, the second terminal 154 is preferably located at the rightmost position among the four terminals.

The second terminal 154, which serves as a ground terminal, is designed to simply come into contact with the corresponding body terminal 200 and has no transmission/reception of any information or signals. Accordingly, the second terminal 154 may be located closest to the drive force receiver 160 because it has low possibility of connection failure even if it is the most affected by vibration. In consideration of the fact that the second terminal 154 is the most affected by vibration, the second terminal 154 must have a larger contact area than that of the first, third and fourth terminals 151, 152 and 153.

Figure 6:
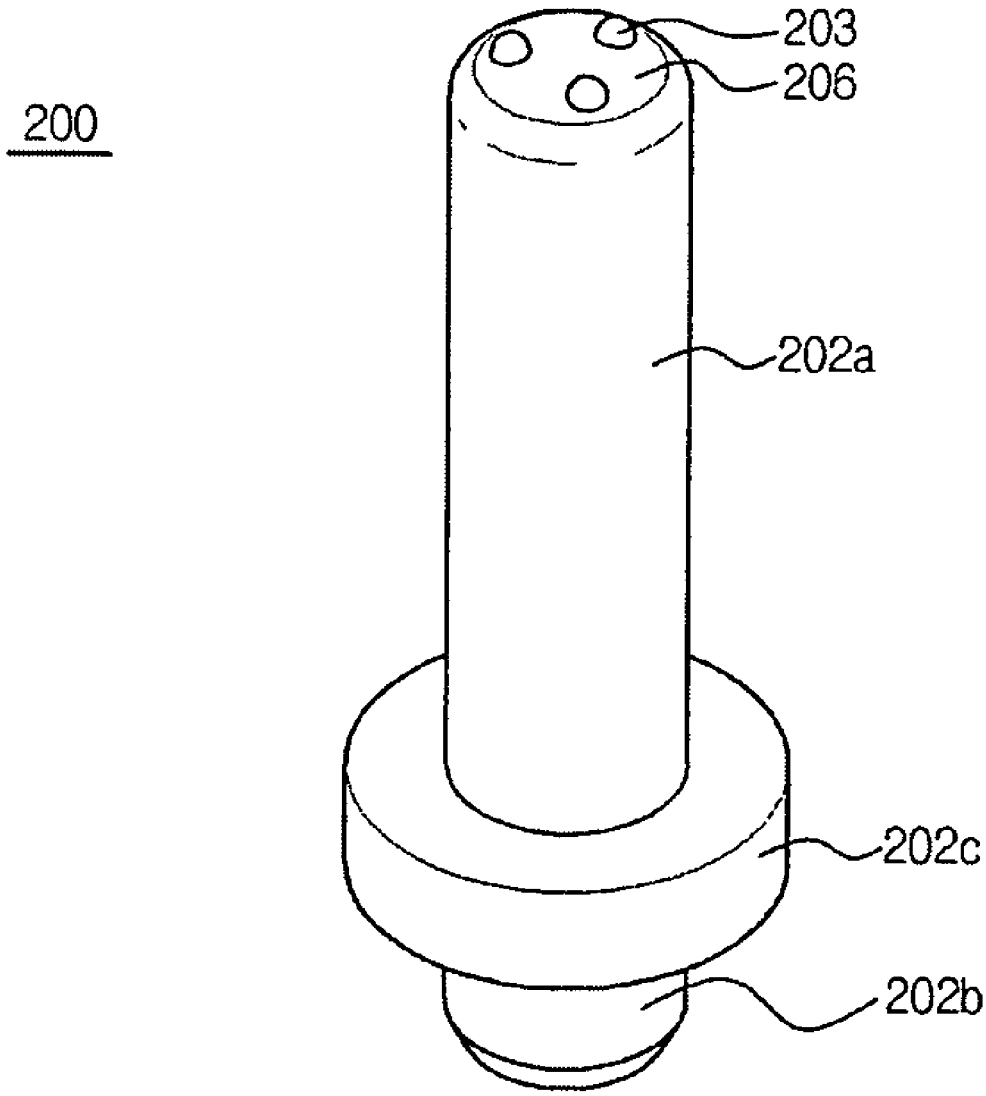
FIG. 6 is a partial perspective view of the body terminal shown in FIG. 1.
Figure 7:
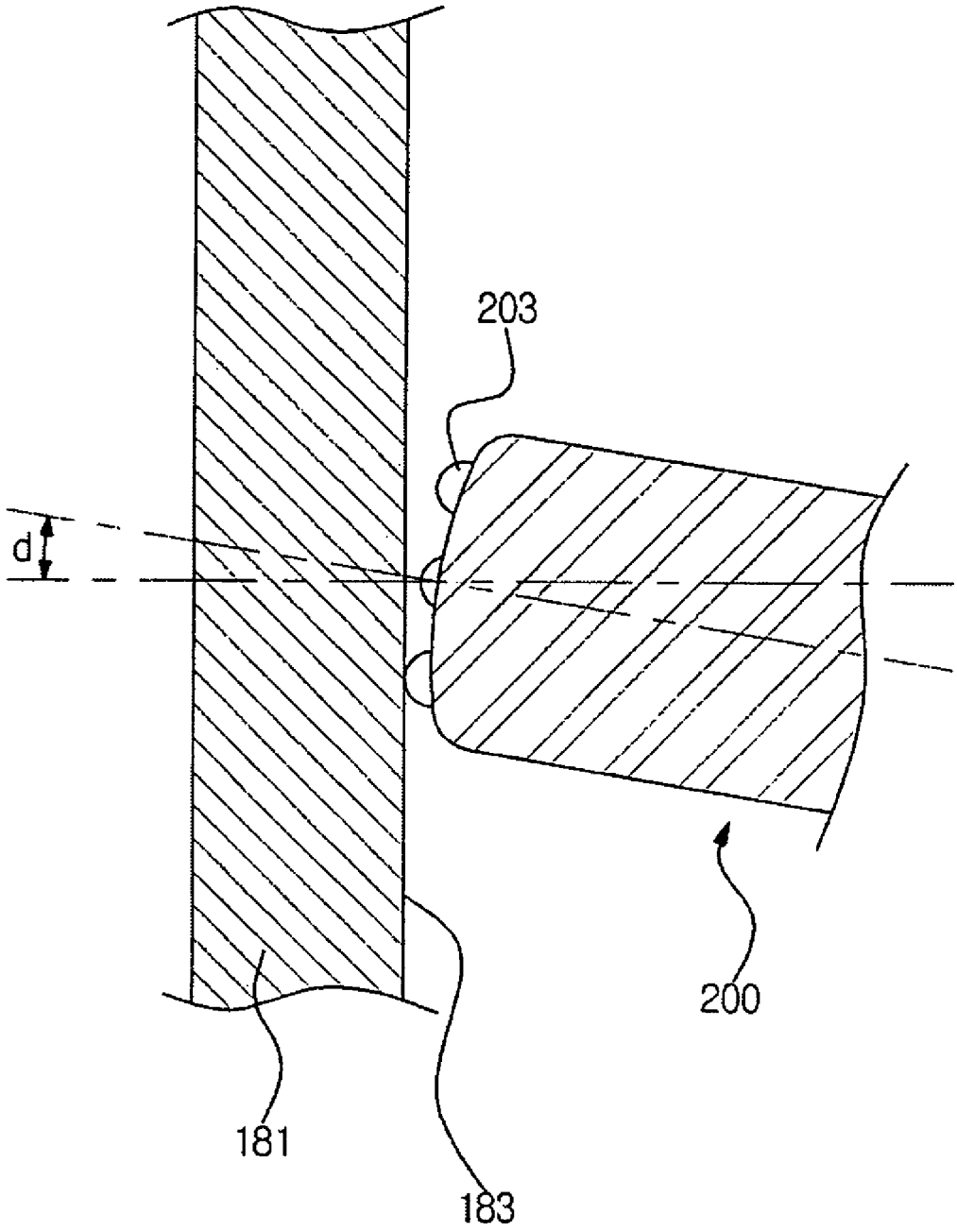
FIG. 7 is a view illustrating operation of the developing device terminal and body terminal shown in FIG. 1.

Hereinafter, detailed configurations of the developing device terminals 181 and the body terminals 200 will be described with reference to FIGS. 5 to 7. Although the developing device terminals 181 includes the first to fourth terminals 151, 154, 152 and 153, each of which comes into contact with corresponding respective the body terminals 200 in a similar manner. Accordingly, hereinafter, the first to fourth terminals 151, 154, 152 and 153 are not particularly identified, but are each represented as the developing device terminal 181.

Figure 5:
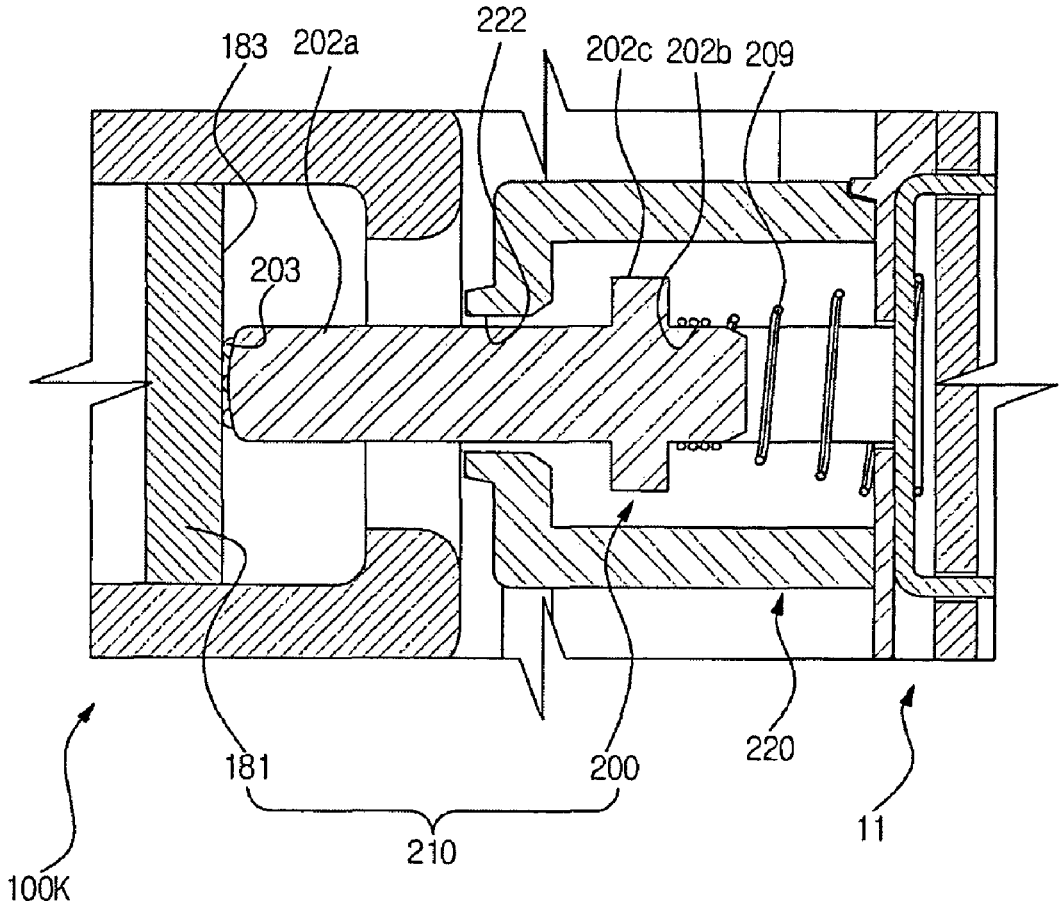
FIG. 5 is a side sectional view illustrating a developing device terminal and a body terminal shown in FIG. 1.

FIG. 5 is a side sectional view illustrating the developing device terminal and the body terminal shown in FIG. 1. FIG. 6 is a partial perspective view of the body terminal shown in FIG. 1.

As shown in the drawings, the image forming apparatus according to the embodiment may include a terminal contactor 210 that may include the developing device terminal 181 provided at the developing device 100K and the body terminal 200 provided at the body cover 11 of the body 10.

The terminal contactor 210 may be used for transmission/reception of electrical signals, power or ground, etc., between the developing device 100K and a variety of electric elements including the circuit board 90 (FIG. 4) provided in the body 10 (FIG. 1). The terminal contactor 210 may preferably be made of a highly conductive material having a low electrical resistance. The terminal contactor 210 serves to electrically connect the circuit board 90 (FIG. 4) and the developing device 100K with each other, and simultaneously, to prevent open-circuiting between the circuit board 90 (FIG. 4) and the developing device 100K due to vibration caused during operation of the drive motor (not shown) provided in the body 10 (FIG. 1).

The developing device terminal 181 may be a conductive flat plate provided at the developing device 100K. The developing device terminal 181 mechanically comes into contact, at a contact surface 183 thereof, with the body terminal 200, and enables transmission/reception of electrical signals, power, ground, etc. between the body terminal 200 and the developing device terminal 181 provided as a conductor. The harness (not shown) may be provided at one side of the developing device terminal 181, to receive or transmit electrical signals, power or ground. The contact surface 183 of the developing device terminal 181 may be plated with, e.g., gold which exhibits a low electrical resistance, to assure effective electric conduction for transmission/reception of electrical signals.

The body terminal 200 is provided on the body cover 11 of the body 10 (FIG. 1). The body terminal 200 is made of a conductive material, so as to effectively receive or transmit electrical signals when the body terminal 200 comes into contact with the developing device terminal 181. The body terminal 200 is received in a body terminal housing 220 provided on the body cover 11. The body terminal housing 220 may include an elastic member 209 to elastically bias the body terminal 200 toward the developing device terminal 181, and a guide hole 222 to guide the body terminal 200 slidably under the influence of an elastic force of the elastic member 209. The body terminal 200 includes a terminal body portion 202*a* penetrating through the guide hole 222, an elastic member coupling portion 202*b* coupled with the elastic member 209, a holding portion 202*c* provided between the terminal body portion 202*a* and the elastic member coupling portion 202*b*, and contact bosses 203 provided at a contact end 206 of the body terminal 200.

The terminal body portion 202*a* may have a cylindrical shape and is made of a conductive material. The terminal body portion 202*a* mechanically comes into contact with the developing device terminal 181, and is electrically connected to the developing device terminal 181. The cylindrical terminal body portion 202*a* can smoothly slide through the guide hole 222 away from or toward the developing device terminal 181.

The elastic member 209 is coupled to the elastic member coupling portion 202*b*. The elastic member 209 elastically biases the body terminal 200 toward the developing device terminal 181, allowing the contact bosses 203 provided at the contact end 206 of the body terminal 200 to come into close contact with the developing device terminal 181. The elastic member 209 is made of an electrically conductive material having elasticity. Accordingly, when the developing device terminal 181 comes into contact with the body terminal 200, electrical signals can be transmitted through the elastic member 209. Although the elastic member 209 of the present embodiment may be a coil spring, of course, there is no limit in the shape of the elastic member.

The contact bosses 203 provide a multi-contact structure at the contact end 206 of the terminal body portion 202*a*. The multi-contact structure provides multiple contacts between the body terminal 200 and the developing device terminal 181. In the foregoing description, when the term contact is used in the context of describing a multi-contact structure, the term should be understood to encompass a point contact, surface contact, or any other contact that allows electrical connection to be made. For example, as shown in FIG. 6, three contact bosses 203 may be arranged at the contact end 206 about an axial center of the body terminal 200 by an approximately constant distance. The three contact bosses 203 may be located, e.g., at three vertexes of a regular triangle. In other words, the three contact bosses 203 define a circle about the center of the body terminal 200. Of course, there is no limit in the number of the contact bosses, and for example, four or more contact bosses may be provided at the contact end 206 of the body terminal 200.

The contact bosses 203 may be integrally formed with the body terminal 200, and may thus be simple to manufacture and can reduce manufacturing costs. As a result of providing the contact end 206 of the body terminal 200 with the contact bosses 203 as protrusions, the contact bosses 203 can serve as actual contact spots between the body terminal 200 and the developing device terminal 181. Also, as a result of distributing the contact bosses 203 at three vertexes of a regular triangle, even if the body terminal 200 is vibrated by external factors such as vibration, etc. caused during operation of the drive motor (not shown), at least one of the three contact bosses 203 will still come into contact with the developing device terminal 181. With this configuration in which the three contact bosses 203 are in contact with the developing device terminal 181, effective electrical connection and reduced electrical resistance between the body terminal 200 and the developing device terminal 181 can be accomplished.

For reference, FIGS. 22 and 23 are tables illustrating experimental results of contact performance between the body terminal 200 and the developing device terminal 181 of the image forming apparatus according to the embodiments. More specifically, FIG. 22 is an experimental table illustrating measured resistance results under normal and abnormal conditions between a developing device terminal and a body terminal having no contact boss, and FIG. 23 is an experimental table illustrating measured resistance results under normal and abnormal conditions between the developing device terminal 181 and the body terminal 200 having three contact bosses. For reference, "abnormal condition" represents a state wherein a surface of the developing device terminal is contaminated with developer due to replacement of the developing device, etc., and "normal condition" represents a state wherein the surface of the developing device terminal exhibits no developer contamination. Also, in the tables, reference letters "Y", "M", "C" and "K" respectively represent yellow, magenta, cyan and black developing devices.

As shown in FIG. 22, assuming that the developing device terminal is in the normal condition and the body terminal has no contact boss, a resistance in the range of 10~100 Ohms was measured 2 times between the body terminal and the developing device terminal and also, a resistance of more than 100 Ohms was measured 6 times. On the other hand, assuming that the developing device terminal is in the abnormal condition and the body terminal has no contact boss, a resistance in the range of 10~100 Ohms was measured 13 times between the body terminal and the developing device terminal and also, a resistance of more than 100 Ohms was measured 133 times. As compared to FIG. 22, FIG. 23 illustrates that a resistance in the range of 10~100 Ohms was not measured between the body terminal 200 having three contact bosses and the developing device terminal under the normal condition. Of course, there was measured no resistance of more than 100 Ohms. Accordingly, even if vibration occurs during initial operation of the image forming apparatus and when external shock is applied, the image forming apparatus of the present embodiment can maintain a stable electric connection having a significantly low electrical resistance between the body terminal and the developing device terminal.

Hereinafter, operation of the developing device terminal and the body terminal will be described in detail with reference to FIG. 7.

As shown, even if the body terminal 200 is tilted by an angle (d) from a normal position due to external factors such as vibration, etc. caused during operation of the drive motor (not shown), one of the three contact bosses 203 maintains the contact with the contact surface 183 of the developing device terminal 181. Accordingly, no open-circuiting occurs between the developing device terminal 181 and the body terminal 200. This has the effect of assuring effective transmission/reception of electrical signals between the developing device 100K and a variety of electric elements including the circuit board 90 (FIG. 4) of the body 10 (FIG. 1).

Also, even if the contact surface 183 is contaminated by the developer, etc., at least one of the three contact bosses 203 can still maintain contact with the developing device terminal 181, assuring effective transmission/reception of electrical signals between the developing device 100K and a variety of electric elements including the circuit board 90 (FIG. 4).

The effective transmission/reception of electrical signals between the developing device terminal 181 and the body terminal 200 can be determined by, e.g., measuring the resistance between the developing device terminal 181 and the body terminal 200.

Experimental results based on the above-described criteria are as follows. Conventionally, under abnormal conditions such as terminal contamination by developer or generation of vibration by rotation of the drive motor, normal transmission/reception of electrical signals have often not been accomplished due to an excessively high resistance value of 100 ohms or more. However, the body terminal 200 according to the above embodiment can achieve a low resistance value of 10 ohms less between the developing device terminal 181 and the body terminal 200 even under the above-described abnormal state, resulting in effective transmission/reception of electrical signals.

Figure 8:
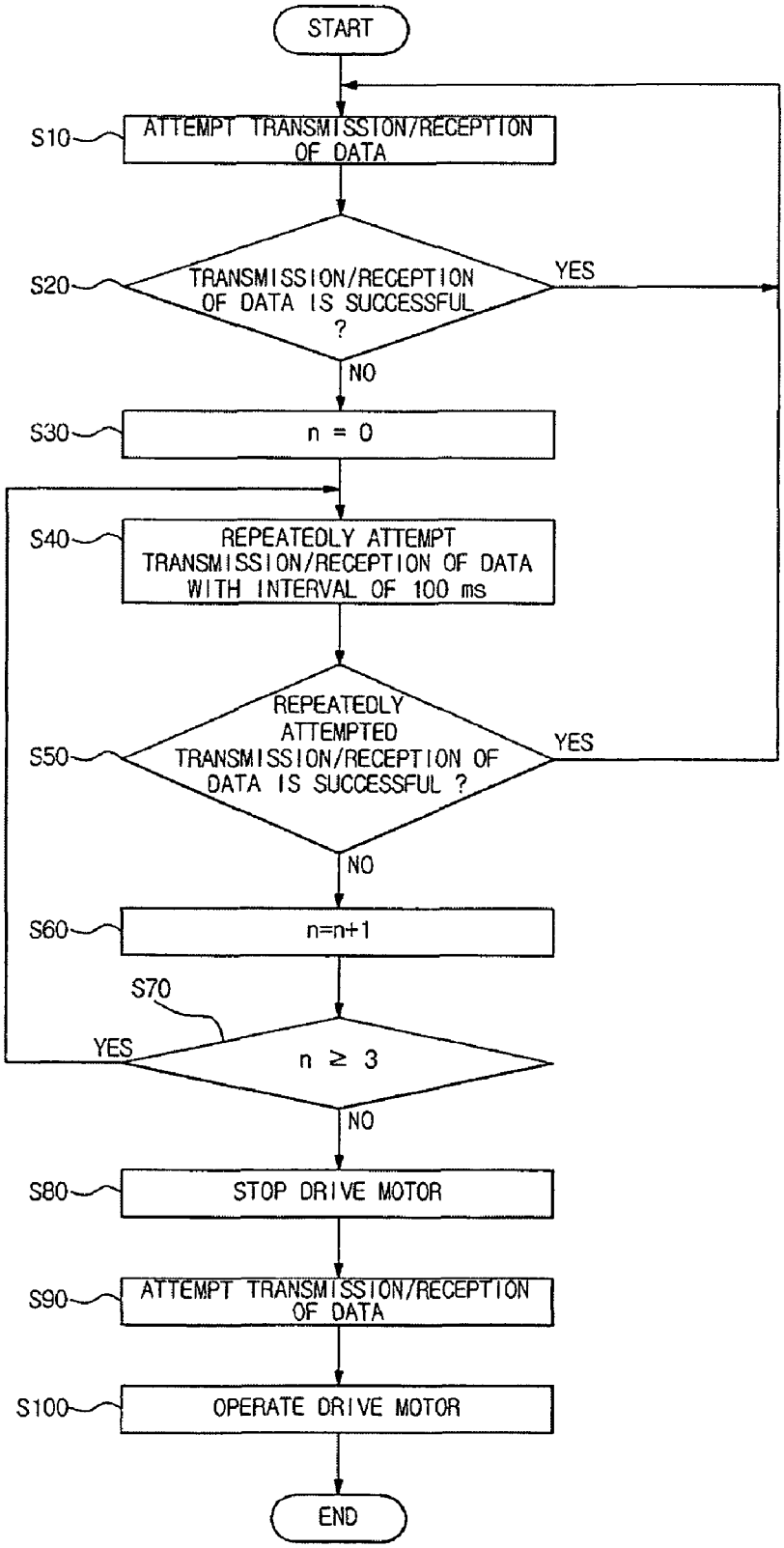
FIG. 8 is a flow chart illustrating operation of the image forming apparatus shown in FIG. 1.

A control method of the image forming apparatus according to the embodiment having the above-described configuration will now be described with reference to FIG. 8 which illustrates an operation of the image forming apparatus shown in FIG. 1.

According to the embodiment, during the operation of the drive motor (not shown), transmission/reception of data between the body and the developing device is still attempted (S10).

After attempting the transmission/reception of data, it is determined whether or not the transmission/reception of data is successful (S20). If the transmission/reception of data has succeeded, the transmission/reception of data is repeatedly attempted, and it is continuously checked whether or not the transmission/reception of data is successful. By virtue of the terminal contactor 210 (FIG. 5) provided between the body 10 (FIG. 1) and the developing device 100K (FIG. 5) to minimize the failure of electrical connection due to vibration, the transmission/reception of data can be efficiently accomplished despite the presence of vibration.

If the transmission/reception of data is unsuccessful, the number of repeated attempts (n) is set to zero (S30), and the transmission/reception of data is repeatedly attempted with an interval of 100 ms (S40). Generally, different magnitudes of vibration occur with a predetermined interval. Accordingly, the transmission/reception of data must be paused to await attenuation of vibration for a sufficient time duration, e.g., 100 ms, and then, be attempted.

Whether or not the transmission/reception of data is repeatedly attempted is determined (S50). If the repeatedly attempted transmission/reception of data is unsuccessful, the number of repeated attempts (n) is increased by one (S60).

Whether or not the number of repeated attempts (n) is more than 3 is determined (S70). If the number of repeated attempts (n) is more than a threshold reference, such as, for example, 3, the drive motor is stopped (S80). If the transmission/reception of data is unsuccessful despite the three or more repeated attempts, this means that exceptionally large vibration continuously occurs. Accordingly, the drive motor as the greatest source of vibration may need to be stopped to attenuate vibration.

After the drive motor is stopped, the transmission/reception of data is again attempted (S90). Efficient transmission/reception of data may be accomplished under the stopped state of the drive motor.

After completing the transmission/reception of data, the drive motor may again be operated (S100).

Figure 9:
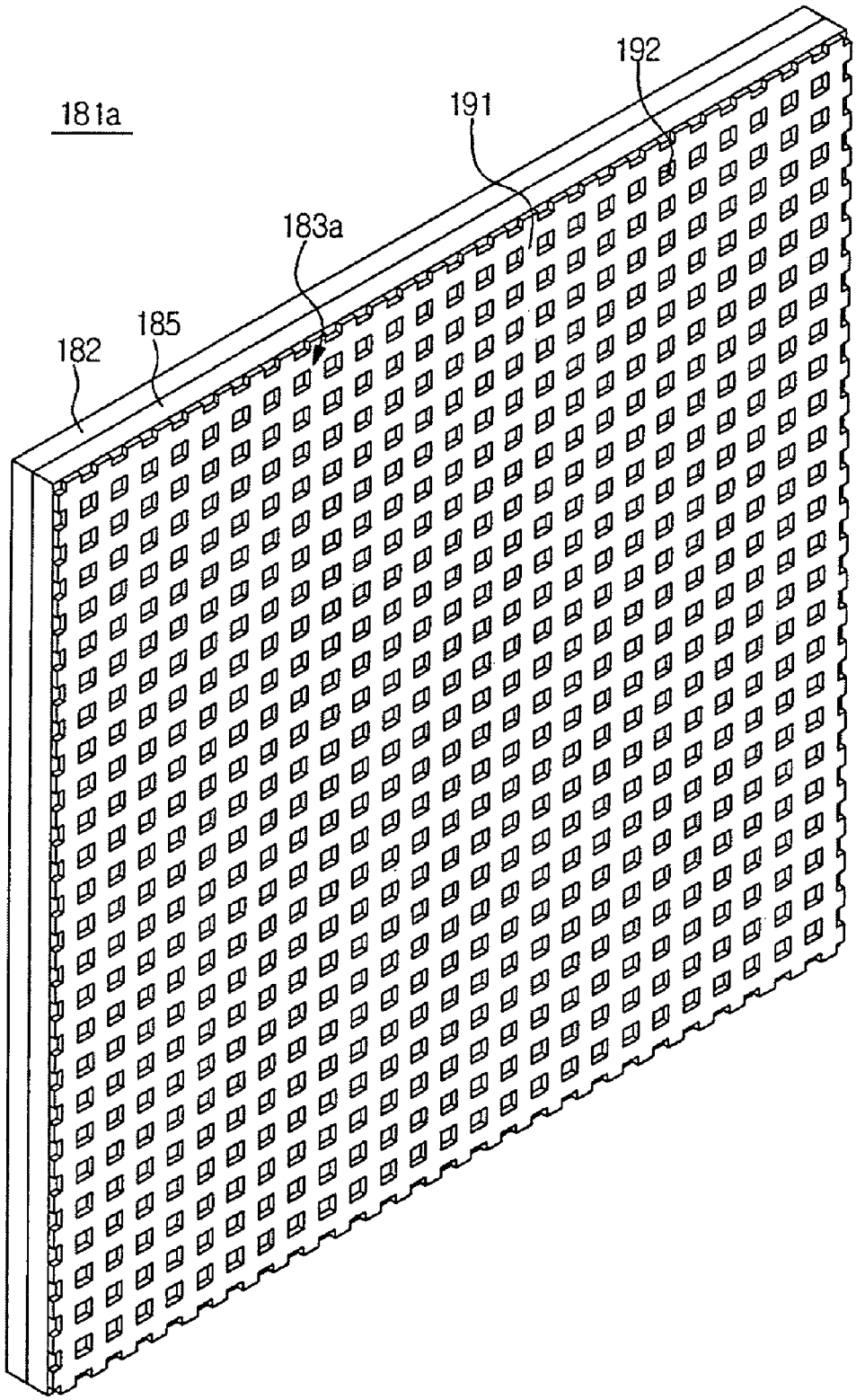
FIG. 9 is a perspective view illustrating a contact surface of a developing device terminal according to another embodiment.

FIG. 9 is a perspective view illustrating a contact surface of the developing device terminal according to another embodiment. Hereinafter, only configurations different from those of the previously described embodiments will be described. For convenience of description, if necessary, the same or similar elements as those of the previous embodiments are denoted by the same reference numerals, and different elements are denoted by reference numerals to which "a" has been appended.

The image forming apparatus according to the embodiment, an example of which is shown in FIG. 9, may include a developing device terminal 181*a* formed with a multi-contact structure. The developing device terminal 181*a* includes a latticed conductive contact surface 183*a*, an elastic plate 185, and a supporting plate 182.

The contact surface 183*a* has a lattice shape and is plated with a conductive material such as, e.g., gold, silver, etc. The contact surface 183*a* has open spaces 192 between horizontal and vertical strips 191.

Figure 10:
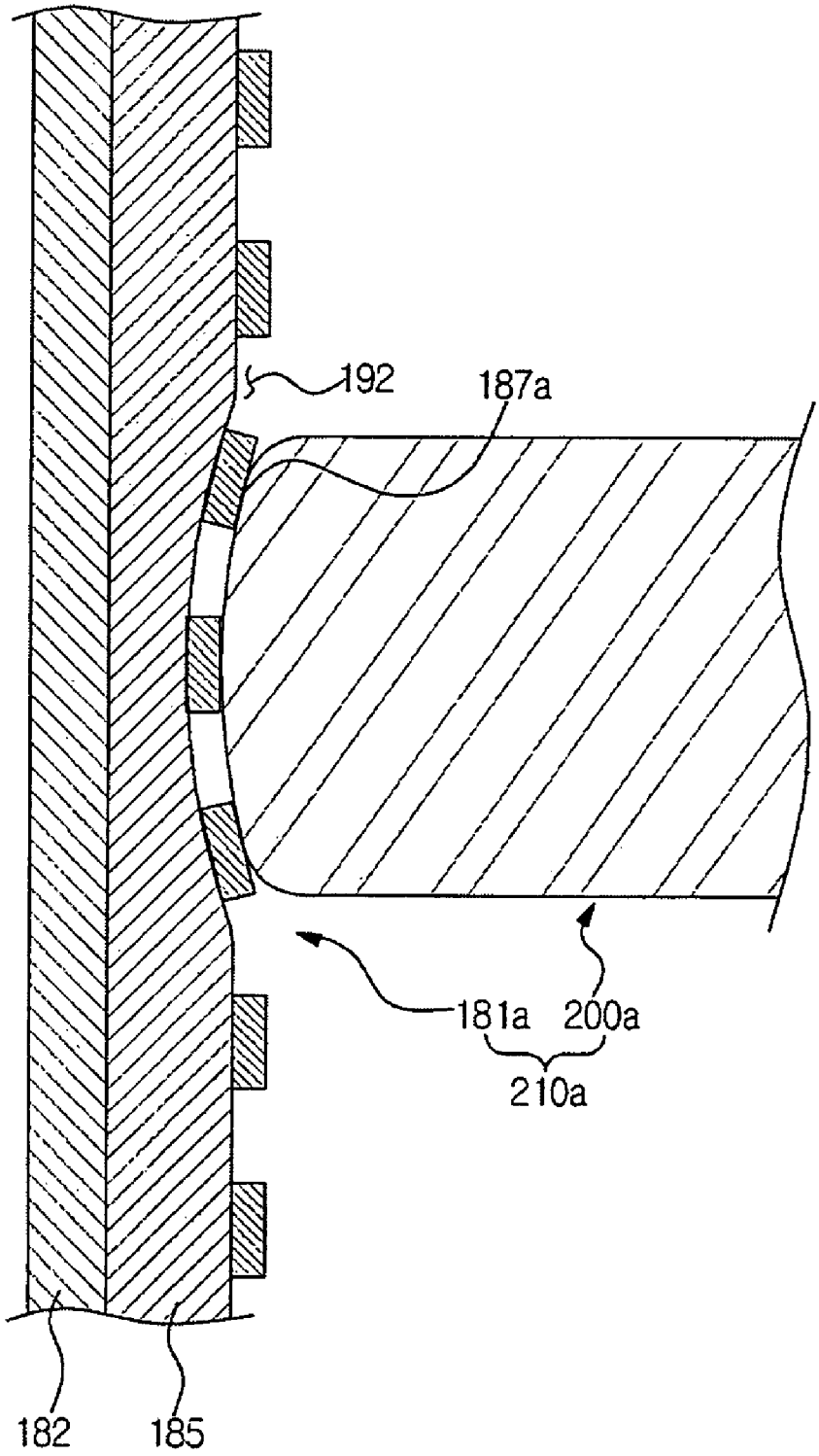
FIG. 10 is a view illustrating operation of the developing device terminal of FIG. 9.

The elastic plate 185 is made of a material suitable to be easily deformed by an external force, such as an elastic polymer film (PET), etc. The elastic plate 185 is deformable by an elastic force of the elastic member 209 (FIG. 5) when the developing device terminal 181*a* comes into contact with the body terminal 200*a* (FIG. 10). The elastic plate 185 can also be returned to its original state when the developing device terminal 181*a* is separated from the body terminal 200*a*.

The supporting plate 182, on which the elastic plate 185 is disposed, serves as a supporting base of the overall developing device terminal 181*a*.

The operation of the image forming apparatus including the above-described configuration will be described with reference to FIG. 10. FIG. 10 illustrates operation of the developing device terminal 181*a* shown in FIG. 9 in detail.

As the body terminal 200*a* of a terminal contactor 210*a* accesses the developing device terminal 181*a* to mechanically come into contact with the developing device terminal 181*a*, the elastic plate 185 is elastically deformed within a range. With the elastic deformation of the elastic plate 185, the open spaces 192 are deformed in shape, resulting in a plurality of contacts 187*a*.

Such electrical connection of the body terminal 200*a* using the plurality of contacts 187*a* significantly reduces the possibility of simultaneous open-circuiting of the plurality of contacts 187*a* even when subjected to vibration caused during operation of the drive motor (not shown), etc. and consequently, enables effective transmission/reception of data.

Figure 11:
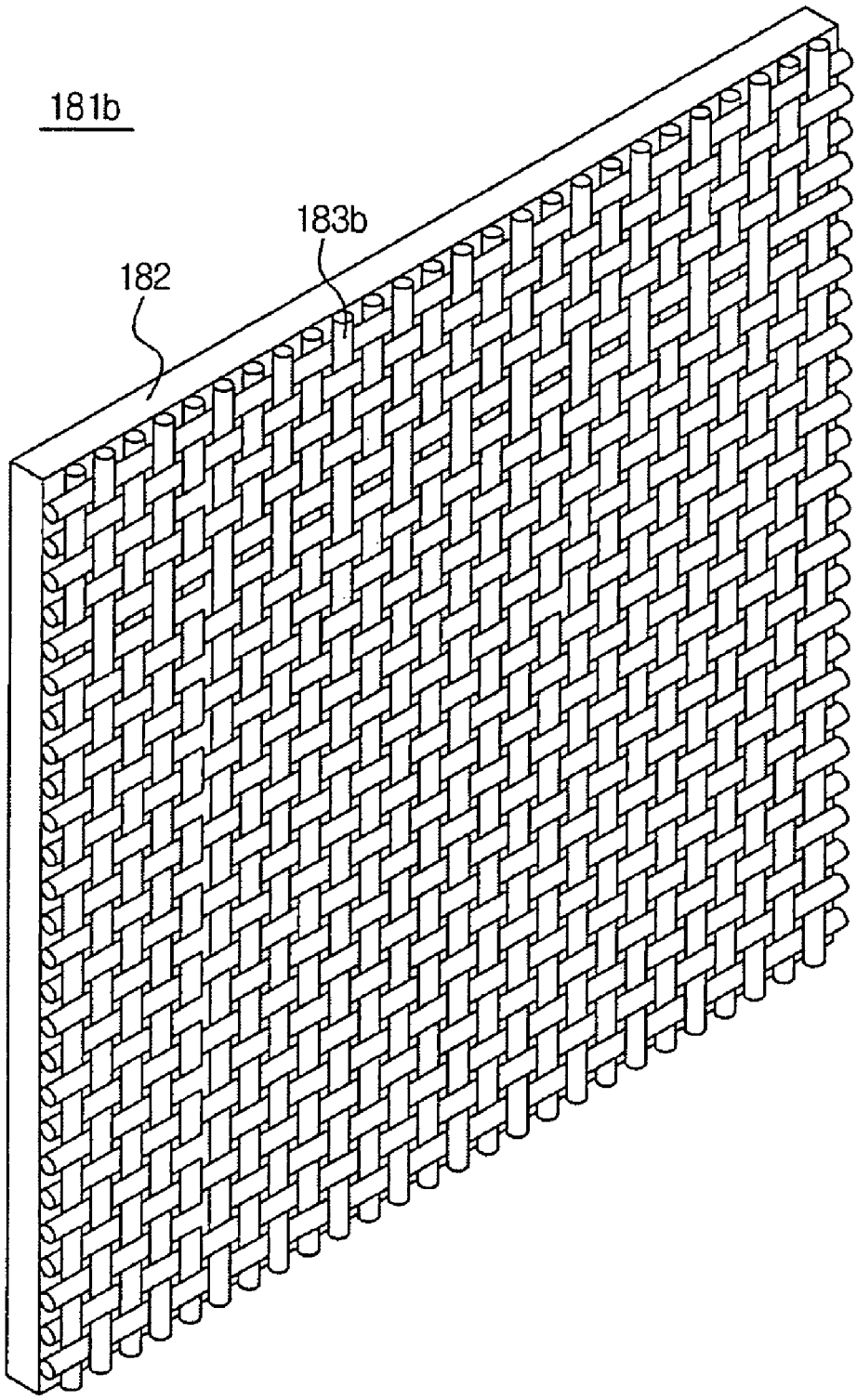
FIG. 11 is a perspective view illustrating a contact surface of a developing device terminal according to another embodiment.
Figure 12:
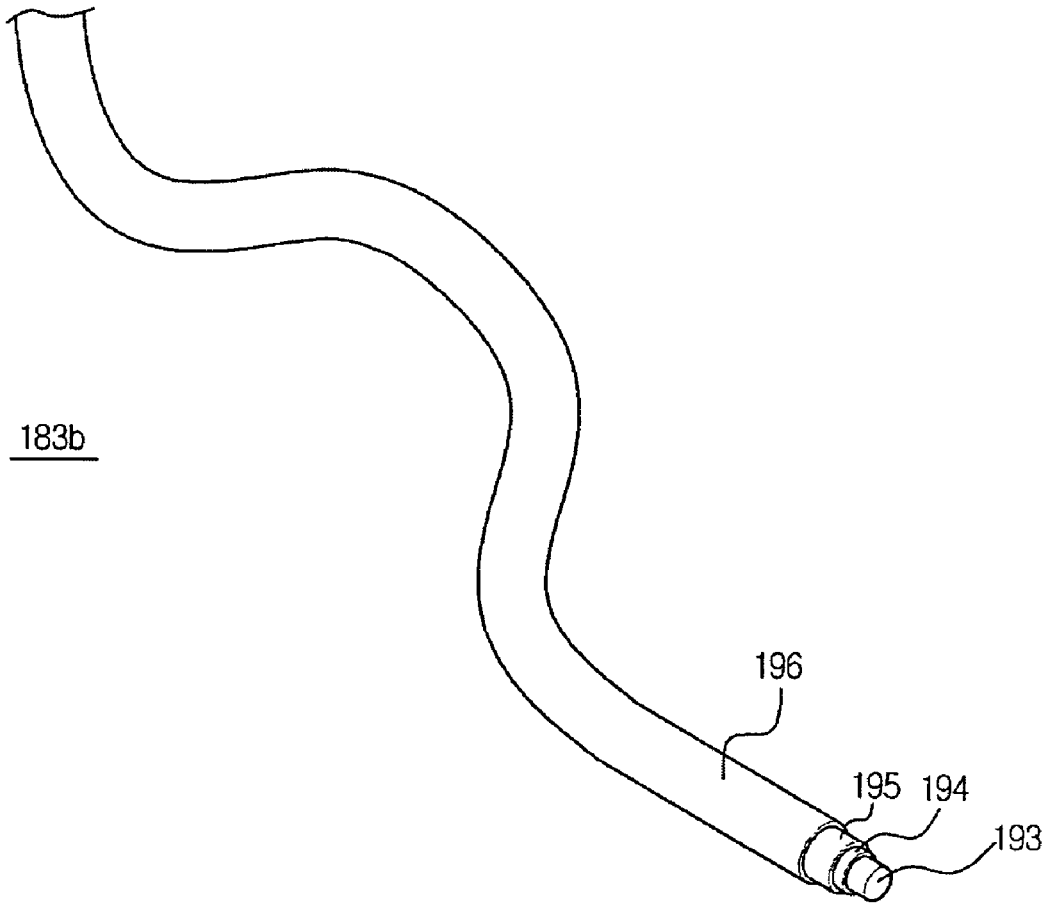
FIG. 12 is a perspective view illustrating a configuration of a multi-layer wire shown in FIG. 11.

FIG. 11 is a perspective view illustrating a contact surface of a developing device terminal according to another embodiment. FIG. 12 is a perspective view illustrating configuration of a multi-layer wire shown in FIG. 11. Hereinafter, only configurations different from those of the previously described embodiments will be described. For convenience of description, if necessary, the same or similar elements as those of the previously described embodiments are denoted by the same reference numerals, and different elements are denoted by reference numerals to which "b" has been appended.

In the image forming apparatus according to the embodiment, an example of which is shown in FIGS. 11 and 12, a multi-contact structure of a developing device terminal 181*b* includes a plurality of elastic conductive tubes 183*b*, which cross one another vertically and horizontally to form a lattice shape.

The elastic conductive tubes 183*b* are provided on a supporting plate 182 of the developing device terminal 181*b*. Each of the elastic conductive tubes 183*b* has an elastic core 193 configured to be easily deformed by an external force, and first, second and third conductive coatings 194, 195, and 196 surrounding the core 193.

The core 193 is made of, for example, an elastic polyester filament. The core 193 can be deformed upon receiving an external force and then, be returned to its original shape as soon as the external force is removed.

The first, second, and third conductive coatings 194, 195, and 196 surround an outer surface of the core 193, and are made of a highly conductive material such as copper (Cu) or nickel (Ni).

Figure 13:
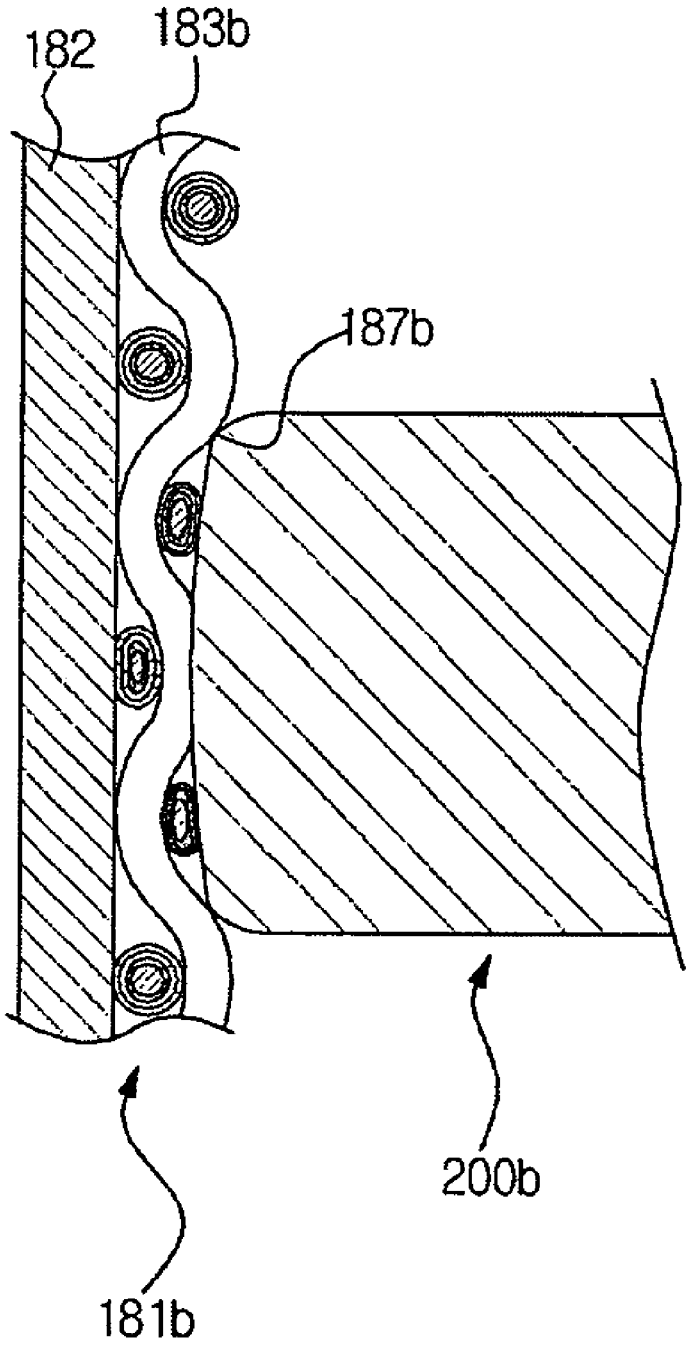
FIG. 13 is a view illustrating operation of the developing device terminal of FIG. 11.

The operation of the image forming apparatus employing the above-described terminal configuration will be described with reference to FIG. 13 which illustrates operation of the developing device terminal 181*b* shown in FIG. 11 in more detail.

As the body terminal 200*b* approaches towards the developing device terminal 181*b* to mechanically come into pressing contact with the developing device terminal 181*b*, the elastic conductive tubes 183*b* are elastically deformed.

The elastic deformation of the elastic conductive tubes 183*b* provides a plurality of contacts 187*b* between the body terminal 200*b* and the elastic conductive tubes 183*b*. With the plurality of contacts 187*b*, the body terminal 200*b* and the elastic conductive tubes 183*b* are electrically connected, enabling transmission/reception of a variety of electrical signals, power or ground, etc. The electrical signals transmitted from the body terminal 200*b* along the elastic conductive tubes 183*b* are transmitted to desired circuit elements of the image forming apparatus through wires (not shown). By virtue of the plurality of contacts 187*b* between the body terminal 200*b* and the elastic conductive tube 183*b*, the electrical connection can be maintained even when the body terminal 200*b* is subjected to vibration, etc.

Figure 14:
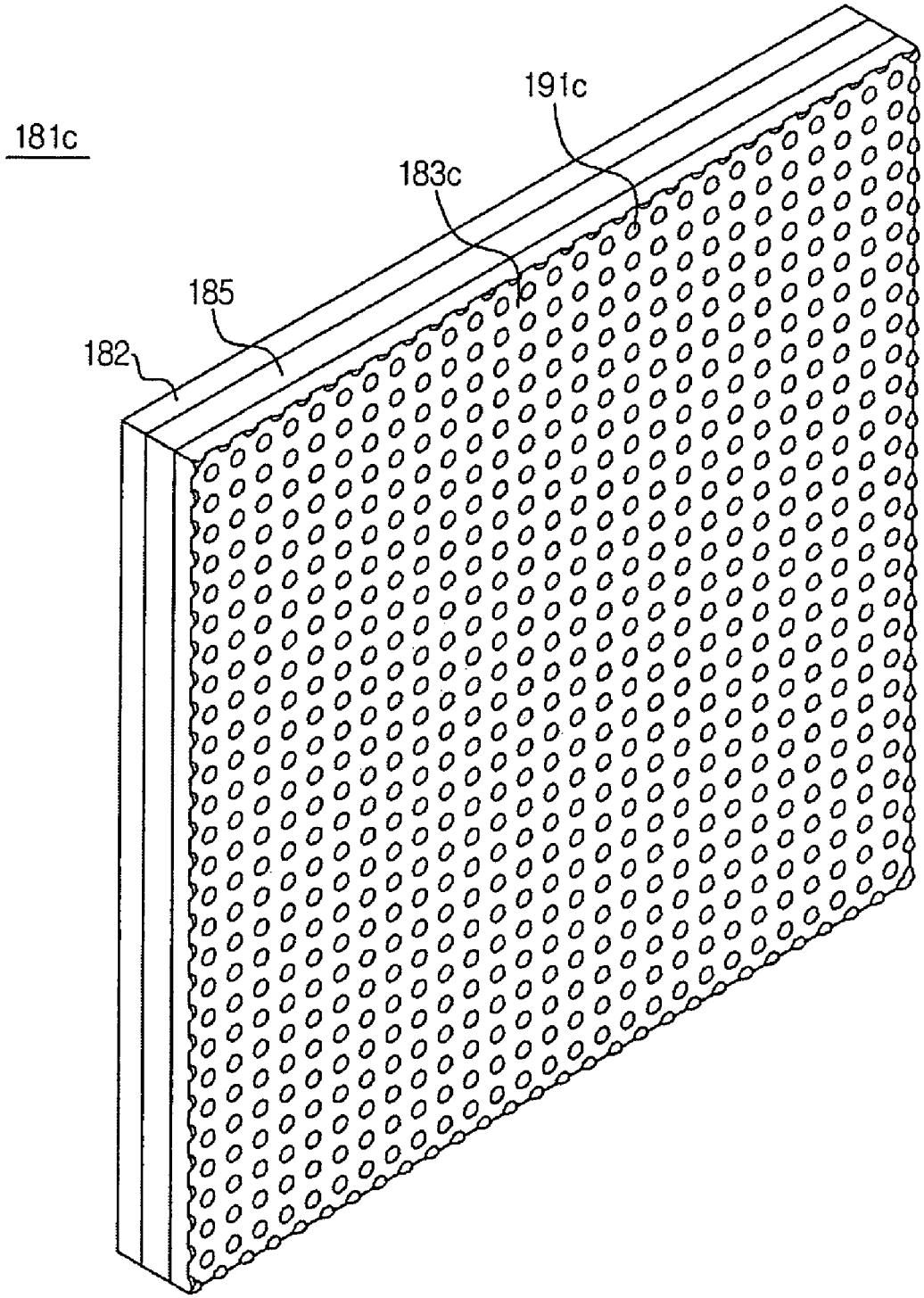
FIG. 14 is a perspective view illustrating a contact surface of a developing device terminal according to another embodiment.
Figure 15:
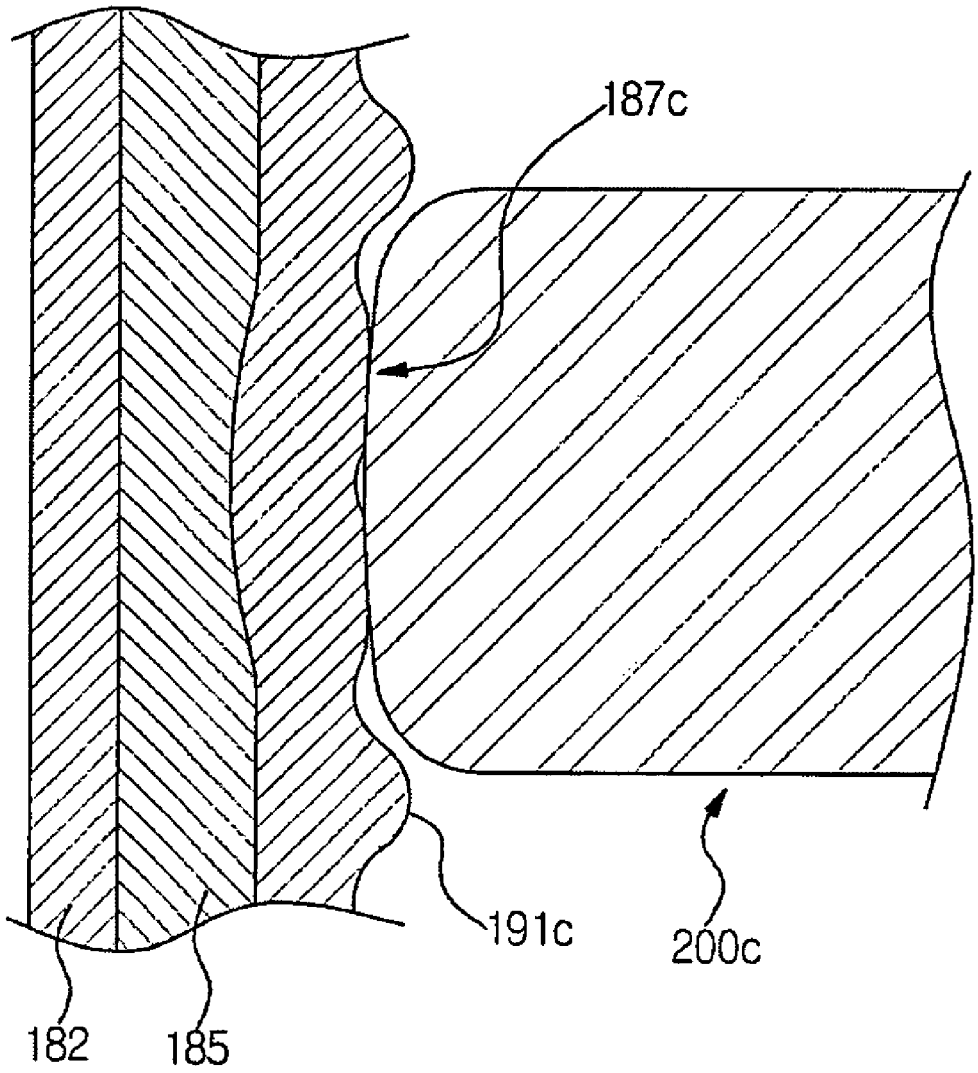
FIG. 15 is a view illustrating operation of the developing device terminal of FIG. 14.

FIG. 14 is a perspective view illustrating a contact surface of a developing device terminal according to yet another embodiment, and FIG. 15 is a view illustrating operation of the terminal shown in FIG. 14. Hereinafter, only configurations different from those of the previously described embodiments will be described. For convenience of description, if necessary, the same or similar elements as those of the previous embodiments are denoted by the same reference numerals, and different elements are denoted by reference numerals to which "c" has been appended.

In the image forming apparatus according to the embodiment, an example of which is shown in FIGS. 14 and 15, a multi-contact structure includes a plurality of elastic conductive bosses 191*c* spaced apart from one another, which is formed, by embossing, on a contact surface 183*c* of a developing device terminal 181*c*.

The elastic conductive bosses 191*c* are arranged on the supporting plate 182 of the developing device terminal 181*c*. An elastic plate 185 is provided between the elastic conductive bosses 191*c* and the supporting plate 182. The elastic conductive bosses 191*c* are provided on the contact surface 183*c* as hemispherical bumps that protrude outwardly toward the body terminal 200*c*.

As the body terminal 200*c* approaches the developing device terminal 181*c* to come into contact with the elastic conductive bosses 191*c*, the elastic conductive bosses 191*c* are deformed in shape together with the elastic plate 185, forming a plurality of contacts 187*c*. Thereby, at least one of the plurality of contacts 187*c* maintains an electrical connection even if the body terminal 200*c* is subjected to vibration.

Figure 16:
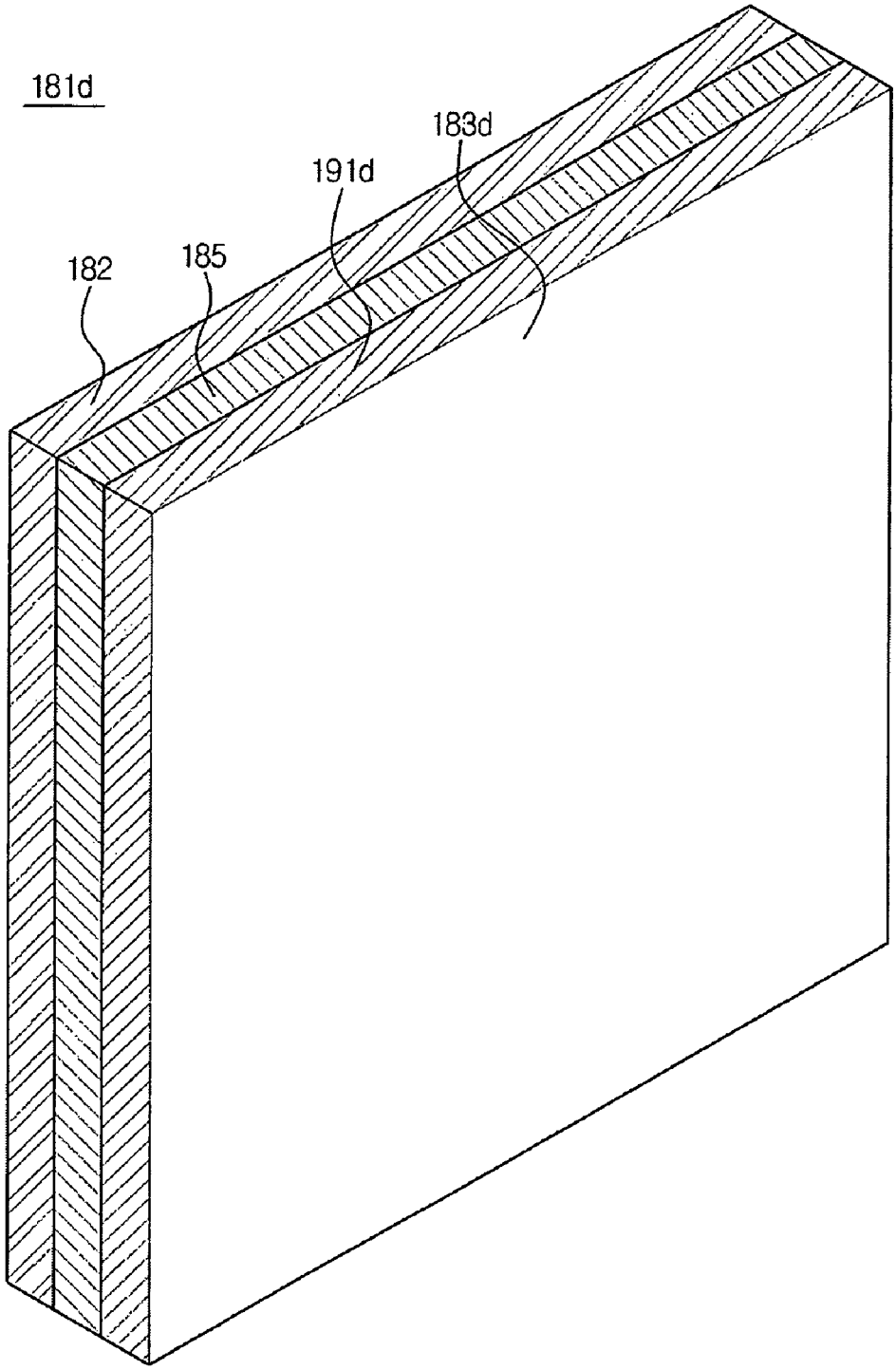
FIG. 16 is a perspective view illustrating a contact surface of a developing device terminal according to another embodiment.
Figure 17:
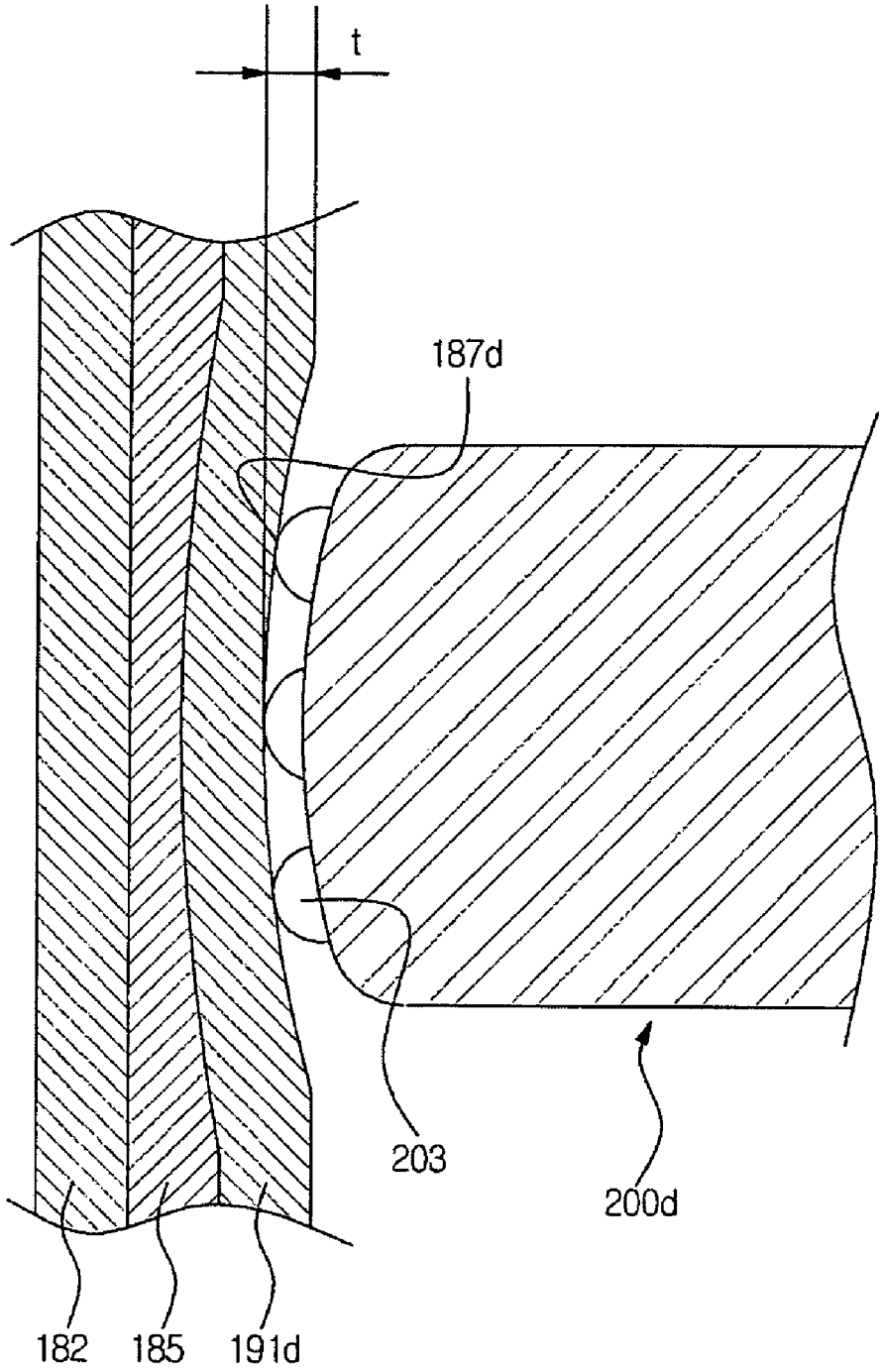
FIG. 17 is a view illustrating operation of the developing device terminal of FIG. 16.

FIG. 16 is a perspective view illustrating a contact surface of a developing device terminal according to even yet another embodiment, and FIG. 17 is a view illustrating operation of the terminal shown in FIG. 16. Hereinafter, only configurations different from those of the previously described embodiments will be described. For convenience of description, if necessary, the same or similar elements as those of the previous embodiments are denoted by the same reference numerals, and different elements are denoted by reference numerals to which "d" has been appended.

In the image forming apparatus according to the embodiment shown in FIGS. 16 and 17, a multi-contact structure includes a conductive flat plate 191*d* provided with a contact surface 183*d* to come into contact with the body terminal 200.

The conductive flat plate 191*d* is disposed on the supporting plate 182 of a developing device terminal 181*d* where the elastic plate 185 is provided between the conductive flat plate 191*d* and the supporting plate 182. The conductive flat plate 191*d* may be made of, for example, aluminum, which exhibits excellent electrical conductivity and elasticity.

As the body terminal 200*d* approaches the developing device terminal 181*d* to come into contact with the contact surface 183*d* of the conductive flat plate 191*d*, the conductive flat plate 191*d* is deformed together with the elastic plate 185. Simultaneously, the contact bosses 203 provided at the body terminal 200 provide three contacts 187*d* on the conductive flat plate 191*d*.

The three contacts obtained by the contact bosses 203 are identical to the previously described first embodiment, the present embodiment however further adopts the elastic deformation of the conductive flat plate 191*d*. Accordingly, even when the body terminal 200 is vibrated during operation of the drive motor (not shown), the conductive flat plate 191*d* can maintain the three contacts owing to the recovery from the elastic deformation variation (t) of the conductive flat plate 191*d*.

Figure 20:
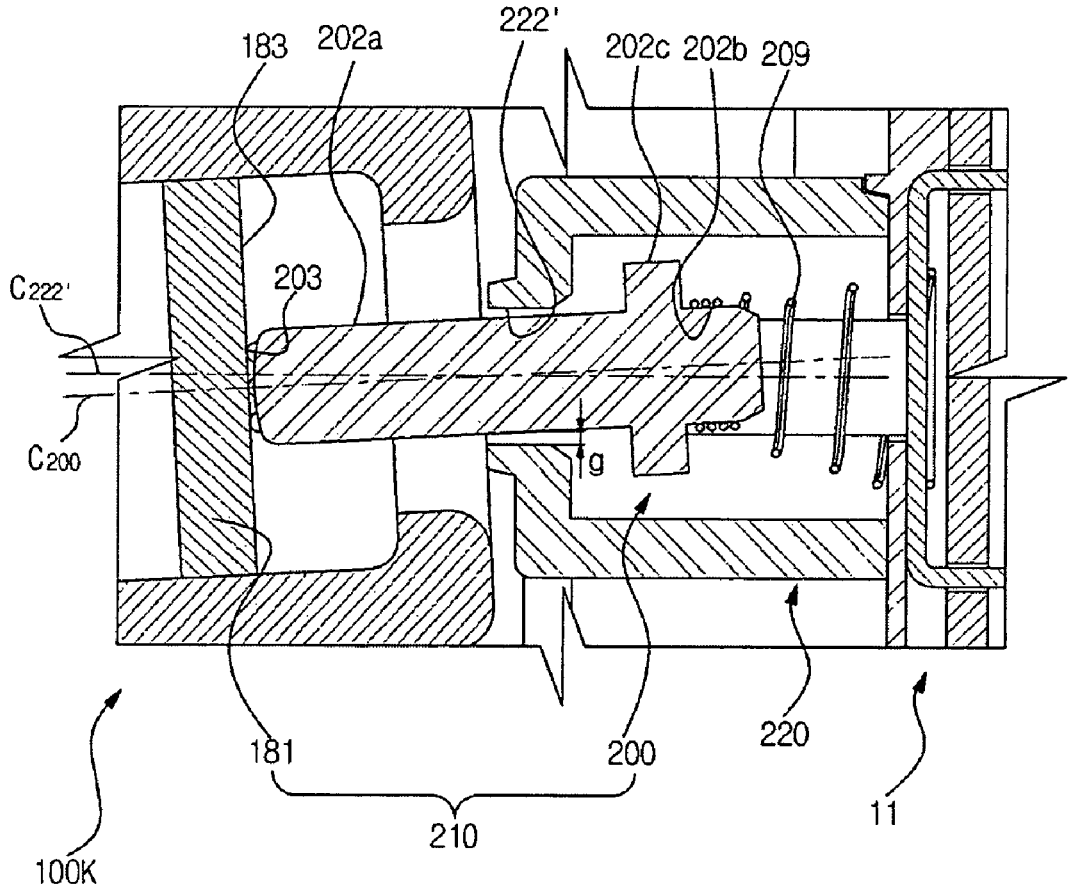
FIG. 20 is a sectional view illustrating a body terminal and a developing device terminal according to a still further embodiment.
Figure 21:
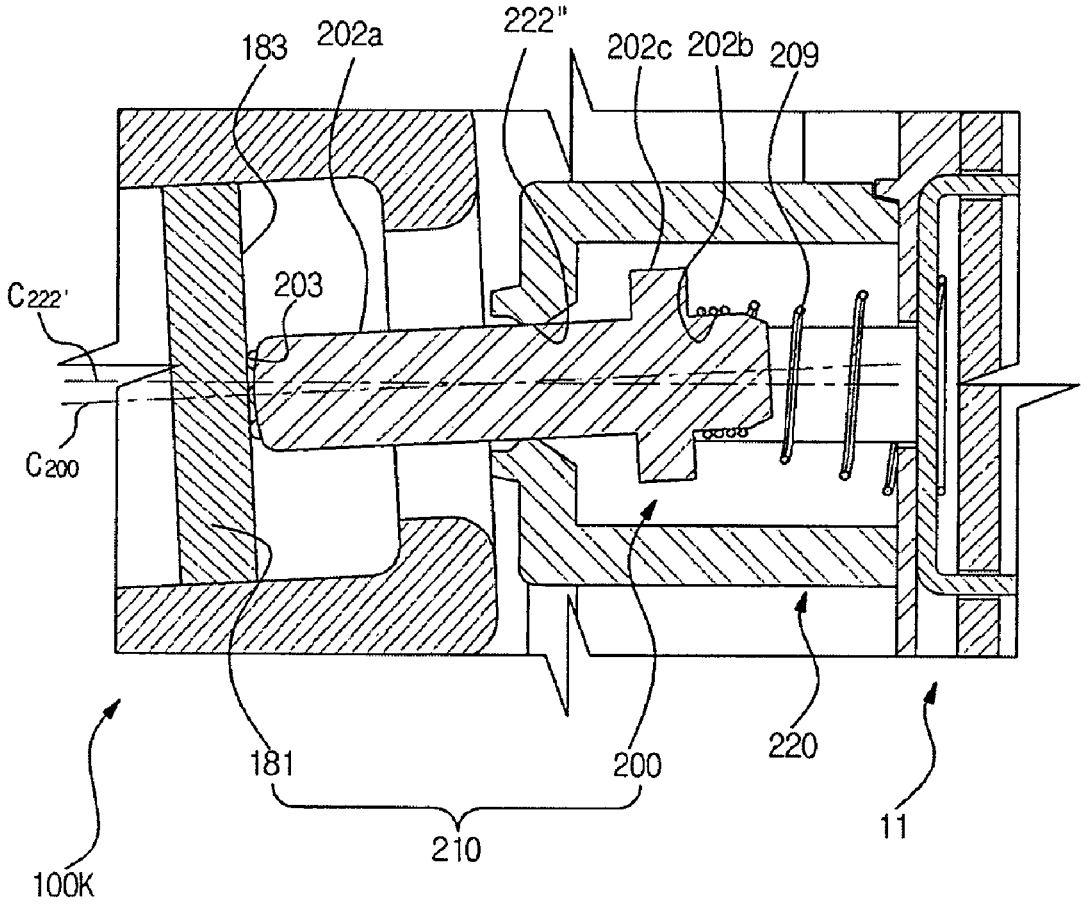
FIG. 21 is a sectional view illustrating a body terminal and a developing device terminal according to a still further embodiment.

FIG. 20 is a sectional view illustrating a body terminal and a developing device terminal according to a still further embodiment, and FIG. 21 is a sectional view illustrating a body terminal and a developing device terminal according to a still further embodiment.

As shown in FIG. 20, a guide hole 222' may have an inner diameter larger than an outer diameter of the body terminal 200, and the body terminal 200 may be tilted by an angle with respect to a center axis $C_{222'}$ of the guide hole 222'. Reference letter "$C_{200}$" represents a center axis of the body terminal 200, and reference letter "g" represents a distance between the body terminal 200 and the guide hole 222'.

Accordingly, in the image forming apparatus of the present embodiment, even if the developing device 100K is tilted within a predetermined angular range, stable contact between the developing device terminal 181 and the body terminal 200 can be maintained. Specifically, even if an angle between the center axis $C_{200}$ of the body terminal 200 and a surface of the developing device terminal 181 escapes the range of 90 degrees, the body terminal 200 of the embodiment is tilted within a predetermined angular range, enabling maintenance of the maximum contact between the surface of the developing device terminal 181 and the contact end of the body terminal 200. This case may occur when the developing device is obliquely mounted to the body or instant vibration or shock is applied to the image forming apparatus.

Of course, as shown in FIG. 21, a guide hole 222" may have an arc-shaped end, to enable tilting of the body terminal 200.

As is apparent from the above description, various embodiments of an image forming apparatus, and a memory unit and control method thereof, may be capable of enhancing the reliability of electrical connection(s) between a developing device and a body with less susceptibility to related failures.

Further, electrical connection failures due to the accumulation of developer, etc. may be reduced.

Furthermore, data transmission/reception between a developing device and a body can be conducted even during operation of a drive motor, etc., which may result in an enhanced printing speed.

Although embodiments have been shown and described, it would be appreciated by those skilled in the art that changes may be made in this embodiment without departing from the principles and spirit of the invention, the scope of which is defined in the claims and their equivalents.

What is claimed is:

1. An image forming apparatus, comprising:

a main body having an opening perforated in one side thereof;

a developing unit detachably mounted to the main body through the opening;

a body cover configured to cover a rear face of the developing unit with respect to a mounting direction of the developing unit, the body cover being adapted to open or close the opening; and a memory unit provided at the rear face of the developing unit and having a developing device terminal, wherein the body cover includes a body terminal that comes into contact with the memory unit and an elastic member provided to elastically bias the body terminal toward the developing device terminal.

2. The image forming apparatus according to claim 1, wherein the body terminal includes one or more body terminals, and at least one of the body terminals includes a plurality of contact bosses provided on one end thereof.

3. The image forming apparatus according to claim 2, wherein the contact bosses include three contact bosses arranged by an approximately constant distance about the center of the body terminal.

4. The image forming apparatus according to claim 2, further comprising:

a body terminal housing provided at the body cover and receiving the body terminal; and a guide hole to guide the body terminal.

5. The image forming apparatus according to claim 4, wherein the body terminal includes a terminal body portion, an elastic member coupling portion to which the elastic member is coupled, and a holding portion provided between the terminal body portion and the elastic member coupling portion.

6. The image forming apparatus according to claim 5, wherein the terminal body portion of the body terminal and the guide hole are spaced apart from each other.

7. The image forming apparatus according to claim 4, wherein the body terminal is provided so as to be tilted by a constant angle with respect to a center axis of the guide hole.

8. The image forming apparatus according to claim 1, wherein the developing unit includes a plurality of developing devices, and wherein at least one of the plurality of developing devices is mounted to the main body so as to be tilted by a predetermined angle with respect to a mounting surface of the image forming apparatus.

9. The image forming apparatus according to claim 1, further comprising a drive force receiver provided at one side of the developing unit and adapted to receive drive force from the main body, wherein the memory unit is arranged closer to an opposite side of the drive force receiver on the basis of the center of a width direction of the developing unit.

10. The image forming apparatus according to claim 9, further comprising a power receiver provided at the other side of the developing unit opposite to one side of the developing unit provided with the drive force receiver with respect to the width direction and adapted to receive electric power from the main body.

11. The image forming apparatus according to claim 10, wherein a waste developer collector to collect waste developer is provided adjacent to the power receiver in a rear region of the main body with respect to the mounting direction of the developing unit.

12. The image forming apparatus according to claim 9, wherein the developing device terminal, and body terminal respectively include a plurality of developing device terminals and a plurality of body terminals, wherein one of the developing device terminals is a data communication terminal, and wherein, of the developing device terminals, the data communication terminal is arranged the farthest from the drive force receiver with respect to the width direction of the developing unit.

13. The image forming apparatus according to claim 9, wherein the developing device terminal and body terminal respectively include a plurality of developing device terminals and a plurality of body terminals, wherein one of the developing device terminals is a ground terminal, and wherein, of the developing device terminals, the ground terminal is arranged the closest from the drive force receiver with respect to the width direction of the developing unit.

14. The image forming apparatus according to claim 13, wherein, of the developing device terminals, the ground terminal has the largest area.

15. The image forming apparatus according to claim 1, further comprising a press member provided at the body cover, wherein the press member presses a rear surface of the developing unit when the developing unit is mounted in the main body.

16. The image forming apparatus according to claim 15, further comprising:

a press member guide provided at the body cover and adapted to guide forward and rearward movement of the press member; and an elastic member provided to elastically bias the press member in a given direction.

17. The image forming apparatus according to claim 1, wherein the developing device terminal includes an elastic plate deformable by an external force, and a conductive plate provided on a contact surface thereof that comes into contact with the body terminal.

18. The image forming apparatus according to claim 1, wherein the developing device terminal includes a latticed conductive plate adapted to come into contact with the body terminal.

19. The image forming apparatus according to claim 1, wherein the developing device terminal includes a latticed elastic conductive tube adapted to come into contact with the body terminal, and wherein the elastic conductive tube includes an elastic core deformable by an external force, and at least one layer of conductive coating over the core.

20. The image forming apparatus according to claim 1, wherein the developing device terminal includes one or more elastic conductive bosses spaced apart from one another and adapted to come into contact with the body terminal.

21. A memory unit of an image forming apparatus, the memory unit being provided at a developing device detachably mounted to a main body of the image forming apparatus, wherein the memory unit has an electrical connection with a body terminal provided at the main body, wherein the body terminal is attached to a body terminal housing provided at a body cover that is able to be opened from or closed to the main body, wherein the body terminal housing comprises an elastic member provided to elastically bias the body terminal toward the memory unit, and a guide hole to guide the body terminal that moves forward and rearward by the elastic member, and wherein the body terminal comprises a terminal body portion adapted to move forward and rearward while coming into contact with an inner circumferential surface of the guide hole, and three contact bosses equidistantly arranged about a center axis of the body terminal for the electrical connection.

* * * * *